US010723148B2

(12) United States Patent
Takeda et al.

(10) Patent No.: US 10,723,148 B2
(45) Date of Patent: Jul. 28, 2020

(54) RECORDING APPARATUS

(71) Applicant: SEIKO EPSON CORPORATION, Tokyo (JP)

(72) Inventors: Kazuhisa Takeda, Shiojiri (JP); Haruna Takahashi, Minamiminowa-mura (JP); Mafumi Kobayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/184,112

(22) Filed: Nov. 8, 2018

(65) Prior Publication Data

US 2019/0143719 A1 May 16, 2019

(30) Foreign Application Priority Data

Nov. 14, 2017 (JP) ..... 2017-219135
Feb. 23, 2018 (JP) ..... 2018-030971

(51) Int. Cl.

| | |
|---|---|
| ***B41J 11/00*** | (2006.01) |
| ***B65H 29/70*** | (2006.01) |
| ***B41J 13/10*** | (2006.01) |
| ***B65H 29/52*** | (2006.01) |
| ***B65H 31/02*** | (2006.01) |

(52) U.S. Cl.

CPC ..... *B41J 11/0045* (2013.01); *B41J 13/106* (2013.01); *B65H 29/52* (2013.01); *B65H 29/70* (2013.01); *B65H 31/02* (2013.01); *B65H 2301/4212* (2013.01); *B65H 2301/51214* (2013.01); *B65H 2402/45* (2013.01); *B65H 2404/63* (2013.01); *B65H 2405/11151* (2013.01); *B65H 2405/324* (2013.01); *B65H 2407/21* (2013.01); *B65H 2601/11* (2013.01); *B65H 2801/15* (2013.01)

(58) Field of Classification Search

CPC ..... B65H 31/26

See application file for complete search history.

(56) References Cited

U.S. PATENT DOCUMENTS

2008/0099973 A1* 5/2008 Kotani ..... B65H 31/26 270/32
2012/0219338 A1* 8/2012 Watanabe ..... G03G 15/6552 399/397

(Continued)

FOREIGN PATENT DOCUMENTS

JP 4444735 B 1/2010
JP 2011235494 A * 11/2011
JP 2014-141350 A 8/2014

*Primary Examiner* — Shelby L Fidler
(74) *Attorney, Agent, or Firm* — Workman Nydegger

(57) ABSTRACT

A printer includes a recording unit which performs recording on paper, an discharge portion which discharges the paper after the recording by the recording unit, a first paper discharge tray on which the paper which is discharge from the discharge portion is placed, and a retainer which includes a plurality of retaining portions which retains the paper toward the first paper discharge tray on a downstream in a medium discharge direction of the discharge portion, in which the plurality of retaining portions includes a first retaining portion and a second retaining portion which retains closer to an upstream in the medium discharge direction than a retaining position of the first retaining portion.

19 Claims, 39 Drawing Sheets

(56) References Cited

U.S. PATENT DOCUMENTS

| | | | | |
|---|---|---|---|---|
| 2013/0135393 | A1* | 5/2013 | Samoto | B65H 5/062 347/47 |
| 2014/0292979 | A1* | 10/2014 | Kodama | B41J 11/0005 347/104 |
| 2017/0066616 | A1* | 3/2017 | Endo | B65H 29/246 |
| 2017/0087887 | A1* | 3/2017 | Hirata | B41J 11/58 |

* cited by examiner

RECORDING APPARATUS

BACKGROUND

1. Technical Field

The present invention relates to a recording apparatus which performs recording on a medium.

2. Related Art

In the related art, an ink jet type recording apparatus is widely known as an example of this type of recording apparatus.

When a liquid is ejected onto a medium to execute recording in an ink jet printer, there is a case in which, after being discharge from the discharge portion onto a paper discharge tray, an opposite surface of the medium from the surface facing the paper discharge tray, that is, a top surface of the medium curls to the inside.

In a case in which the grain of the medium is a "longitudinal grain" which goes along the medium transport direction, the medium curls in a width direction which intersects the medium transport direction and both side edges of the medium face upward. In a case in which the grain of the medium is a "latitudinal grain" which goes along the width direction, the medium curls in the medium transport direction and the leading end and the rear end of the medium in the medium transport direction face upward.

In a case in which the recording of a plurality of sheets is performed consecutively, when such curling arises in the medium which is previously discharge, the plurality of media which is discharge onto the paper discharge tray may not be stacked in an aligned manner on the paper discharge tray.

The curled previous medium may impede the discharging of the following medium from the discharge portion.

JP-A-2014-141350 discloses a pair of retaining members which are provided on a downstream in a medium discharge direction with respect to the discharge portion so as to leave an interval in the width direction which intersects the medium discharge direction. In JP-A-2014-141350, the rear end of the medium is retained by the pair of retaining members and the stacking properties of the medium on the paper discharge tray are improved.

Here, in a case in which the grain of the medium is a "latitudinal grain" going along the width direction, the medium curls not only at the upstream in the medium transport direction, but also at the downstream. In the configuration of JP-A-2014-141350, although it may be possible to retain the curled portion on the upstream in the medium transport direction, the curled portion on the downstream may not be retained and the previous medium which is curled may impede the following medium.

SUMMARY

An advantage of some aspects of the invention is to provide a recording apparatus capable of maintaining favorable stacking properties of a medium on a paper discharge tray.

According to an aspect of the invention, there is provided a recording apparatus including a recording unit which performs recording on a medium, an discharge portion which discharges the medium after the recording by the recording unit, a placement portion on which the medium which is discharge from the discharge portion is placed, and a retainer which includes a plurality of retaining portions which retains the medium toward the placement portion on a downstream in a medium discharge direction of the discharge portion, in which the plurality of retaining portions includes a first retaining portion and a second retaining portion which retains closer to an upstream in the medium discharge direction than a retaining position of the first retaining portion.

In this configuration, since the plurality of retaining portions which retains the medium toward the placement portion includes, on the downstream in the medium discharge direction of the discharge portion, the first retaining portion and the second retaining portion which retains closer to an upstream in the medium discharge direction than the retaining position of the first retaining portion, it is possible to favorably maintain the stacking properties of the medium on the placement portion by retaining both the upstream and the downstream of the medium which curls in the medium discharge direction (for example, the medium which is discharge with a latitudinal grain).

The second retaining portion may be disposed deviated in a width direction which intersects the medium discharge direction with respect to the first retaining portion, the first retaining portion may be provided in a center region in the width direction, and the second retaining portion may be provided as a pair on both sides of the first retaining portion in the width direction.

In this configuration, since the second retaining portion is disposed deviated in the width direction which intersects the medium discharge direction with respect to the first retaining portion, the first retaining portion is provided in the center region in the width direction, and the second retaining portion is provided as a pair on both sides of the first retaining portion in the width direction, it is possible to more reliably retain the curling of the medium.

In addition to suppressing the curling in the medium discharge direction (for example, the medium which is discharge with a latitudinal grain), it is also possible to suppress the curling in the width direction (for example, the medium which is discharge with a longitudinal grain).

The plurality of retaining portions may further include a third retaining portion or a third retaining portion to an nth retaining portion ($n \geq 4$) in addition to the first retaining portion and the second retaining portion, and in which a kth retaining portion ($n \geq k \geq 3$) is provided as a pair on both sides of a k-1th retaining position ($n \geq k \geq 3$) in the width direction which intersects the medium discharge direction and the kth retaining portion is configured to retain closer to the upstream in the medium discharge direction than the retaining position of the k-1th retaining portion ($n \geq k \geq 3$).

In this configuration, the plurality of retaining portions is configured to further include a third retaining portion or third to nth retaining portions ($n \geq 4$), kth retaining portions ($n \geq k \geq 3$) are provided as a pair on both sides of the k-1-th retaining portions ($n \geq k \geq 3$) in the width direction and are configured to retain closer to the upstream in the medium discharge direction than the retaining position of the k-1-th retaining portion ($n \geq k \geq 3$), and thus, it is possible to handle a greater number of sizes of the medium.

In the recording apparatus, the retaining portions may include rotational movement shafts on the discharge portion side, may rock using the rotational movement shafts as axes, and may be configured such that free ends which proceed and withdraw with respect to the medium retain the medium.

In this configuration, since the retaining portions include rotational movement shafts on the discharge portion side, rock using the rotational movement shafts as axes, and are configured such that free ends which proceed and withdraw with respect to the medium retain the medium, the retaining portions may be pushed by the medium, for example, and escape in a withdrawal direction separating from the medium. Therefore, it is possible to reduce the concern of the pressing force of the retaining portions from excessively being applied to the medium.

In the plurality of retaining portions, the closer the retaining portion is positioned to an outside in the width direction, the greater a retaining force which retains the medium toward the placement portion may be.

In this configuration, since a configuration is adopted in which the closer the retaining portion is positioned to the outside in the width direction, the greater the retaining force which retains the medium toward the placement portion, it is possible to adopt a configuration in which the medium of a large size in the width direction is securely retained by the retaining portion.

A predetermined retaining portion among the plurality of retaining portions may overlap the top side of the retaining portion which is first positioned on the outside in the width direction with respect to the predetermined retaining portion.

In this configuration, it is possible to easily realize a configuration in which the closer the retaining portion is positioned to an outside in the width direction, the greater a retaining force which retains the medium toward the placement portion. It is possible to adopt a configuration in which the predetermined retaining portion rocks following the rocking of the retaining portion which is positioned first on the outside in the width direction with respect to the predetermined retaining portion.

The retaining portions may be configured to be capable of rotationally moving by an angle greater than or equal to 90° from a horizontal plane in a case in which the retaining portions rotationally move in a direction separating from the placement portion from a retaining posture which retains the medium toward the placement portion.

In this configuration, since the retaining portions are configured to be capable of rotationally moving by an angle greater than or equal to 90° from a horizontal plane in a case in which the retaining portions rotationally move in a direction separating from the placement portion from a retaining posture, it is possible to reduce the concern of the retaining portions becoming a hindrance, the retaining portions coming into contact with the medium and damaging the medium, and the like when the medium is removed from the placement portion after the recording.

The recording apparatus may further include a cover portion which is capable of opening and closing and covers a space above the rotational movement shafts in a closed state, in which the cover portion may be configured to be pushed up by the retaining portions which rotationally move in a direction separating from the placement portion and to be capable of rotationally moving from the closed state to an open state.

When the rotational movement shafts which are the connecting portions between the retaining portions and the apparatus main body are exposed to the outside, the rotational movement shafts are easily accessed, leading to destruction, and there is a concern that smooth rotational movement of the retaining portions is hindered by the adherence of dust and the like to the rotational movement shafts.

In this configuration, since it is possible to suppress the problems described above using the cover portion and the cover portion is capable of rotationally moving, it is also possible to suppress the hindrance to the rotational movement of the retaining portions.

The recording apparatus may further include a housing in which the discharge portion is provided, in which the rotational movement shafts may include a first rotational movement shaft and a second rotational movement shaft, in which each of the retaining portions may include a base member which rocks in a direction proceeding and withdrawing with respect to the placement portion using the first rotational movement shaft which is provided on the housing side as an axis, and a distal end member which rocks in a direction of proceeding and withdrawing with respect to the placement portion using the second rotational movement shaft which is provided on a free end side of the base member as an axis, the distal end member retaining the medium toward the placement portion, in which the first rotational movement shaft may be positioned such that a space above the first rotational movement shaft is covered by a portion of the housing, and in which the second rotational movement shaft may be positioned such that a space above the second rotational movement shaft is not covered by the housing.

In this configuration, it is possible to realize a configuration in which, in a case in which the retaining portions rotationally move from a posture in which the retaining portions retain the medium in a direction separating from the medium, the retaining portions are capable of rotationally moving from the horizontal plane by an angle greater than or equal to 90° without providing the cover which opens and closes the housing following the rotational movement of the retaining portions.

The base members may be pressed in a progress direction in which the medium is retained toward the placement portion by a pressing member, and in a case in which the retaining portions rotationally move from the retaining posture in a direction of separating from the placement portion, when the distal end members rotationally move by a predetermined angle with respect to the base members, the base members rotationally move in a direction of separating from the placement portion against a pressing force of the pressing member.

In this configuration, it is possible to configure the retaining portions to easily return to a progressed state in which the medium is suppressed.

Among the plurality of retaining portions, the second retaining portion and the third retaining portion, or the second to the nth retaining portions ($n \geq 4$) may be provided at positions corresponding to both ends in the width direction of the media of respectively different sizes.

In this configuration, it is possible to adopt a configuration in which the end portions in the width direction of the media of varied sizes are reliably retained. Therefore, it is possible to more reliably suppress the curling of the medium.

The recording apparatus may further include a curved path which is provided on an upstream of the discharge portion in the medium discharge direction and which curves and inverts the medium after the recording by the recording unit.

In this configuration, similar operations and effects to those of the configurations described above may be obtained in a recording apparatus which discharges the medium using a face-down system in which the recording surface faces downward.

In the recording apparatus which discharges the medium using a face-down system, when the medium curls with the recording surface facing the outside, since the curling deforms to face the top side, although the medium which is placed on the placement portion easily blocks the discharge portion, it is possible to adopt a recording apparatus capable of effectively suppressing the curling.

The retaining portions may have a discharging function. In this configuration, since the retaining portions have a discharging function, since it is not necessary to provide a discharging portion separate from the retaining portion, it is sufficient to have a lower number of parts and it is possible to realize a reduction in the number of processes and a cost reduction.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

First, a description will be given of an outline of a recording apparatus according to an embodiment of the invention. An ink jet printer 1 (hereinafter this may be referred to as simply the printer 1) is an example of the recording apparatus of the present embodiment. The recording apparatus according to the invention is not limited to an ink jet printer and, for example, may be configured as a laser printer.

Figure 1:
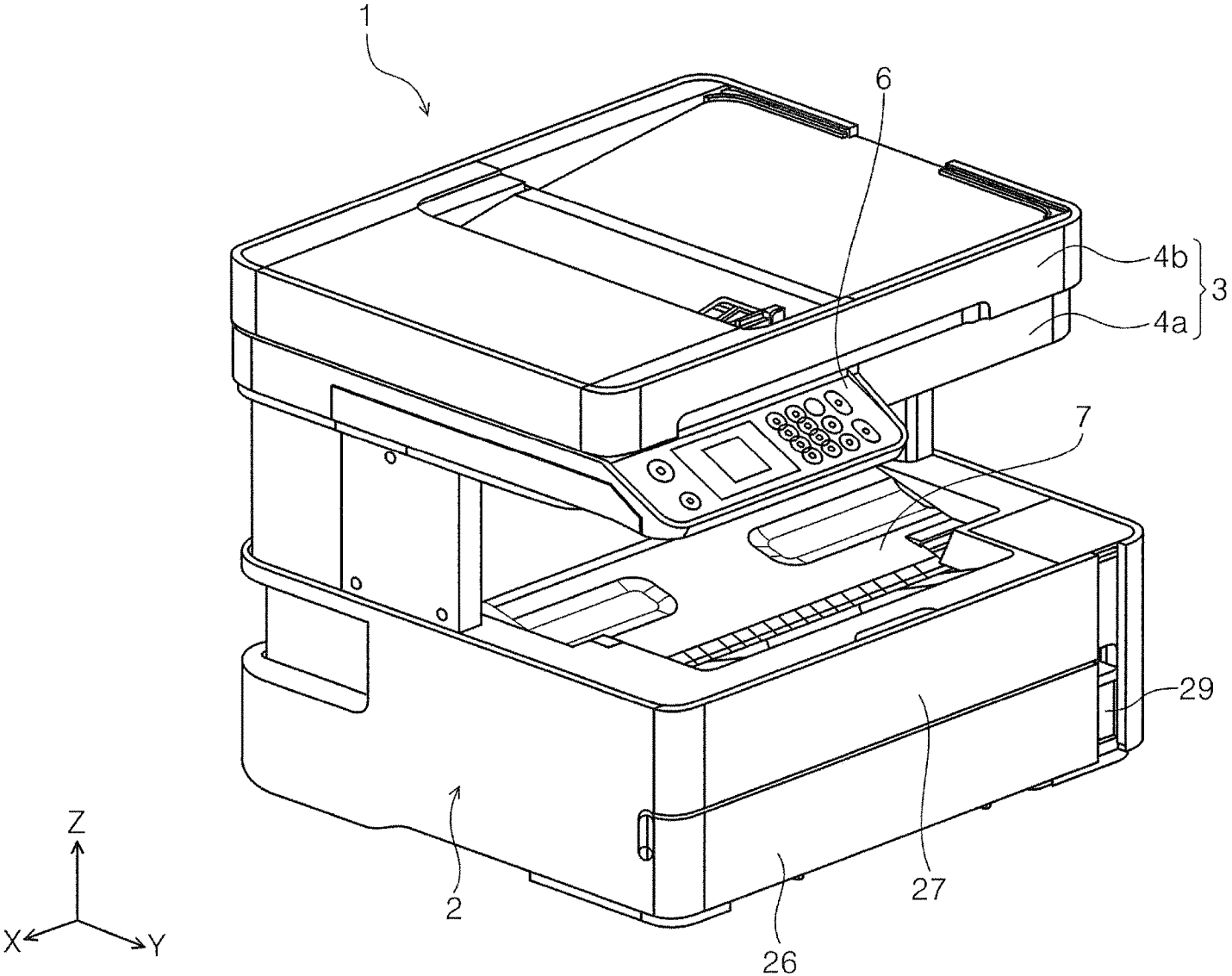
FIG. 1 is an external perspective view of a printer according to a first embodiment.
Figure 2:
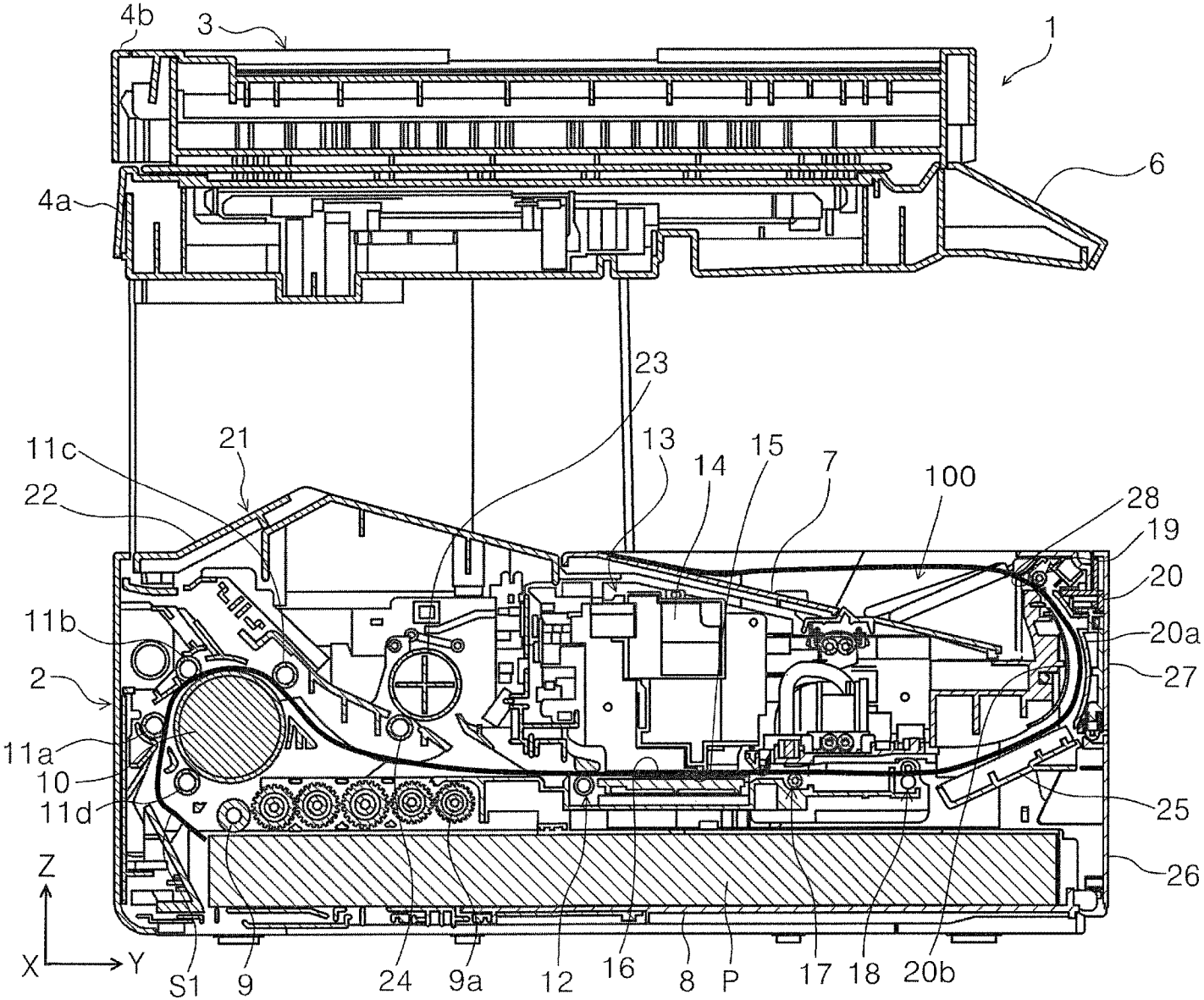
FIG. 2 is a lateral sectional diagram illustrating a transport path of a paper which is transported from a medium storage portion of the printer according to the first embodiment.
Figure 3:
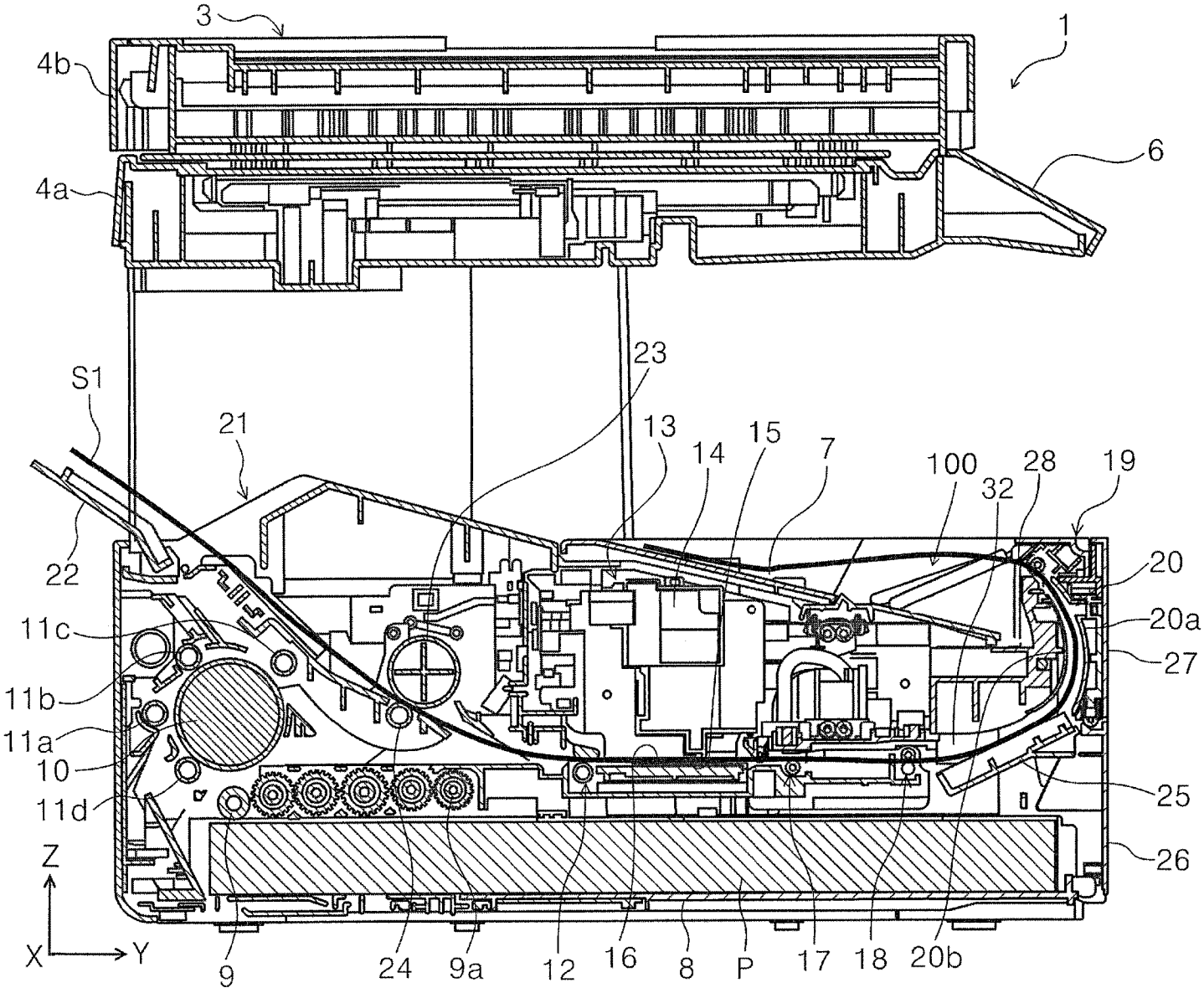
FIG. 3 is a lateral sectional diagram illustrating the transport path of the paper which is transported from a rear side feed unit of the printer according to the first embodiment.
Figure 4:
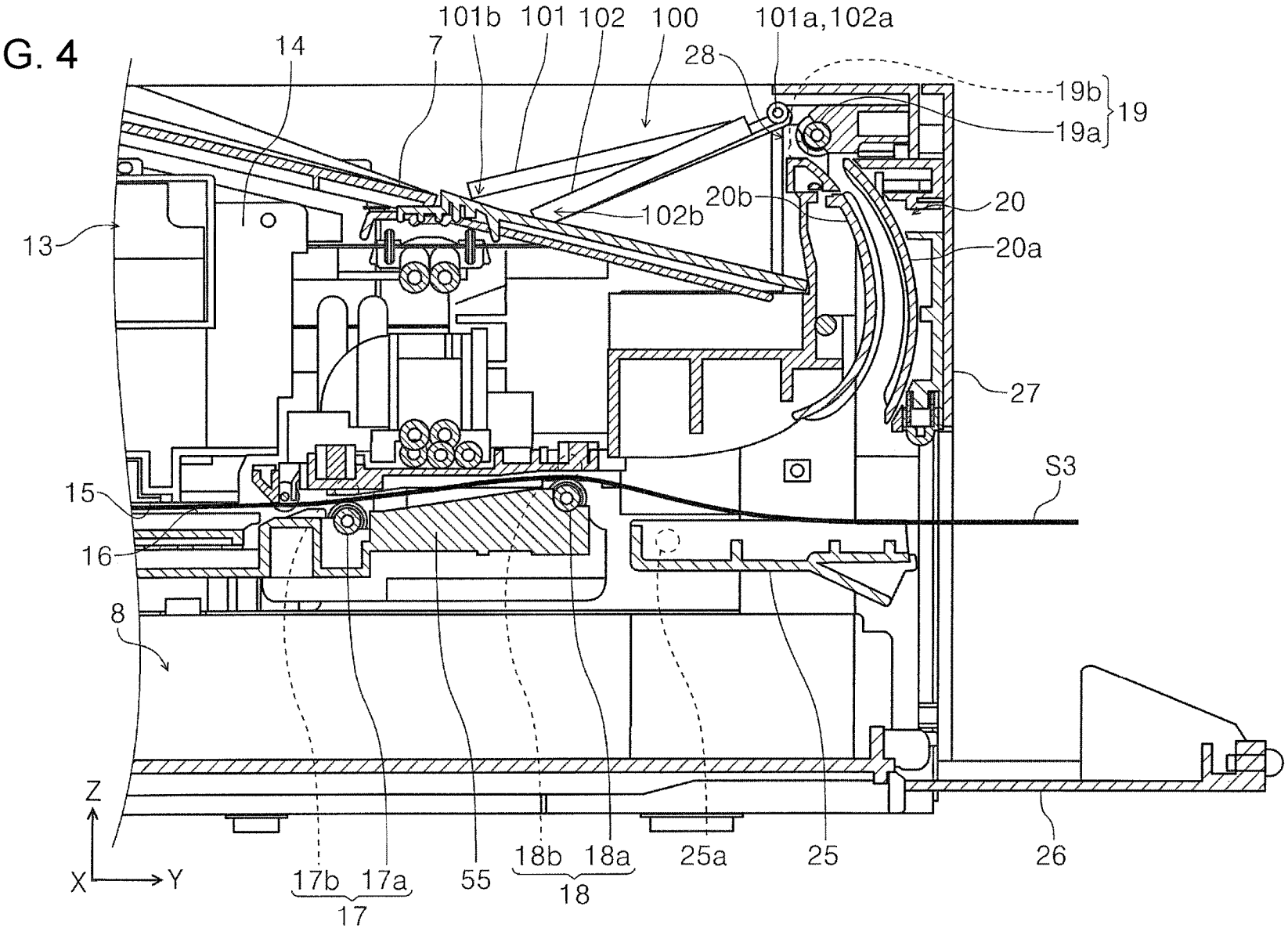
FIG. 4 is a lateral sectional diagram illustrating a support portion in a second state in which a first cover is opened in the printer according to the first embodiment.
Figure 5:
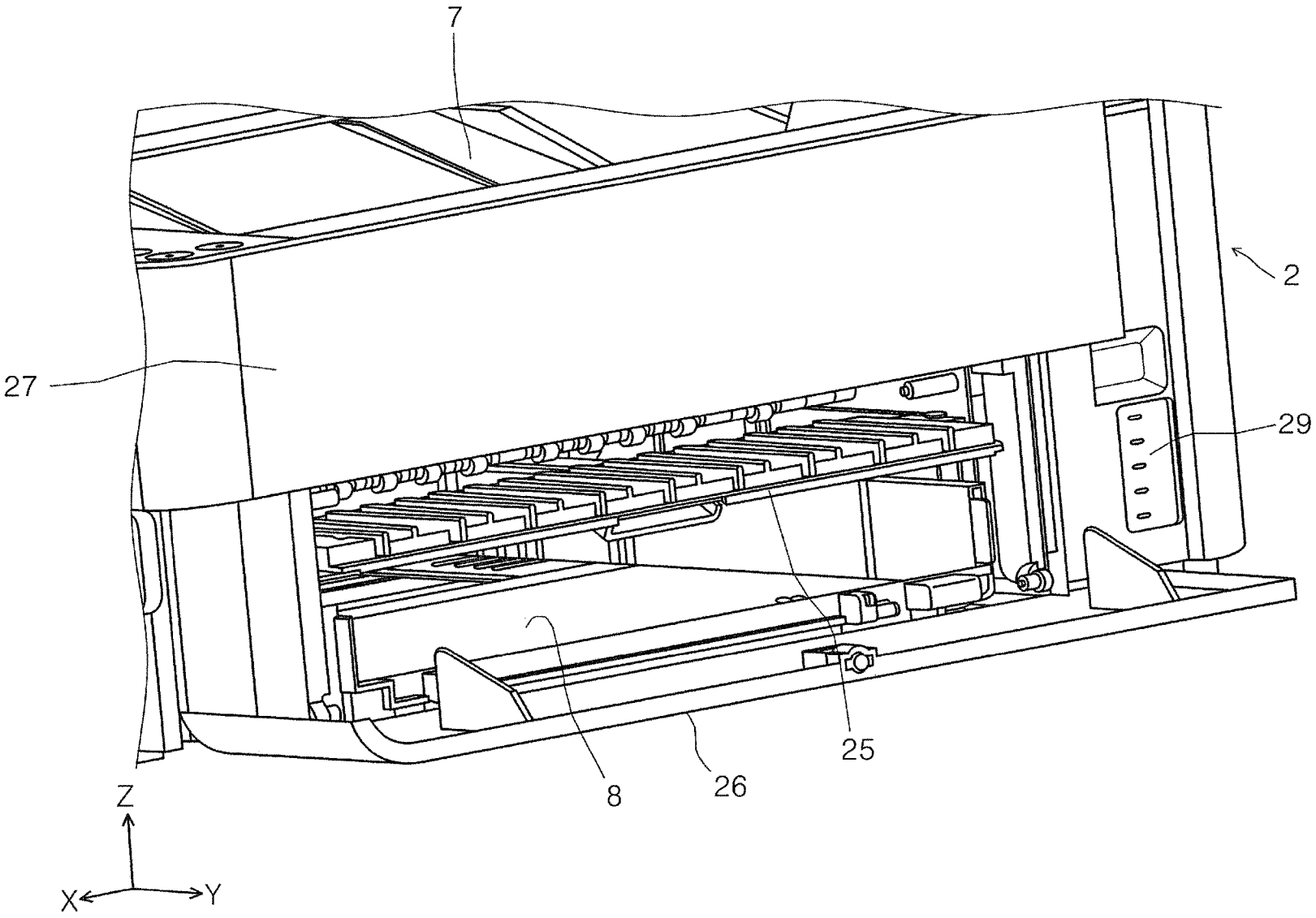
FIG. 5 is a perspective view illustrating the support portion in the second state in which the first cover is opened in the printer according to the first embodiment.
Figure 6:
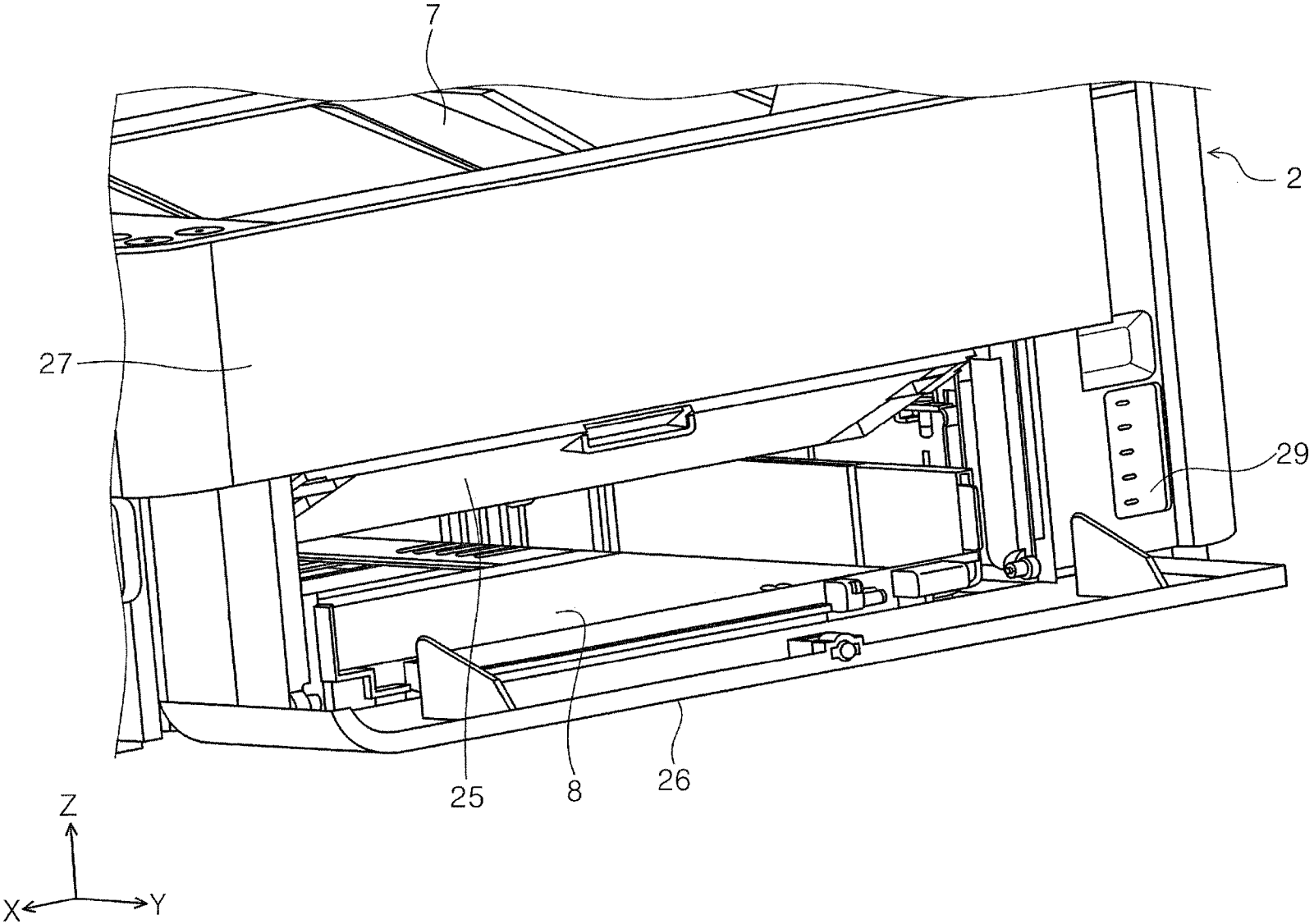
FIG. 6 is a perspective view illustrating the support portion in a first state in which the first cover is opened in the printer according to the first embodiment.

FIG. 1 is an external perspective view of a printer according to a first embodiment. FIG. 2 is a lateral sectional diagram illustrating a transport path of a paper which is transported from a medium storage portion of the printer according to the first embodiment. FIG. 3 is a lateral sectional diagram illustrating the transport path of the paper which is transported from a rear side feed unit of the printer according to the first embodiment. FIG. 4 is a lateral sectional diagram illustrating a support portion in a second state in which a first cover is opened in the printer according to the first embodiment. FIG. 5 is a perspective view illustrating the support portion in the second state in which the first cover is opened in the printer according to the first embodiment. FIG. 6 is a perspective view illustrating the support portion in a first state in which the first cover is opened in the printer according to the first embodiment.

Figure 7:
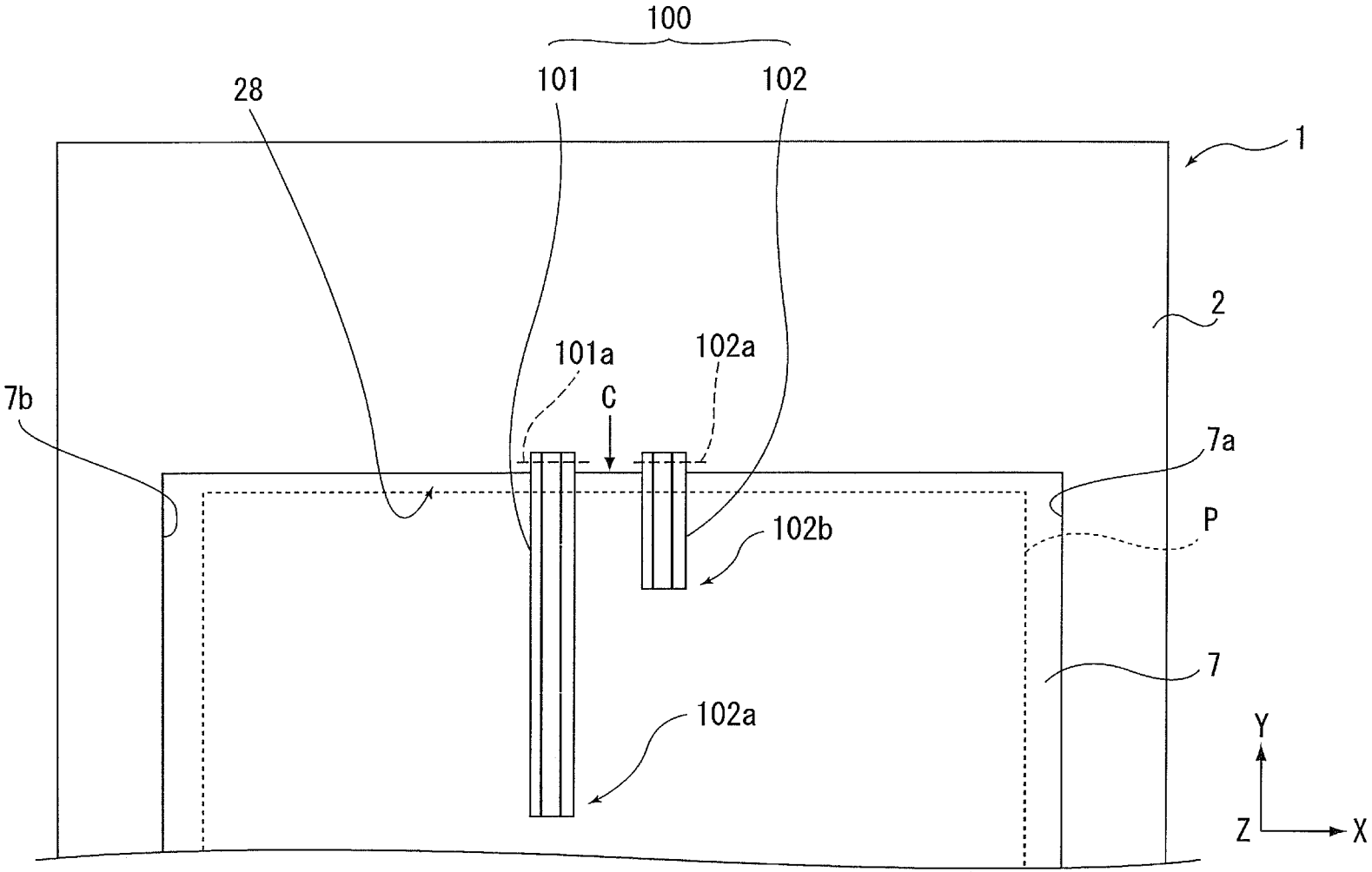
FIG. 7 is a schematic plan view of a retainer according to the first embodiment.
Figure 8:
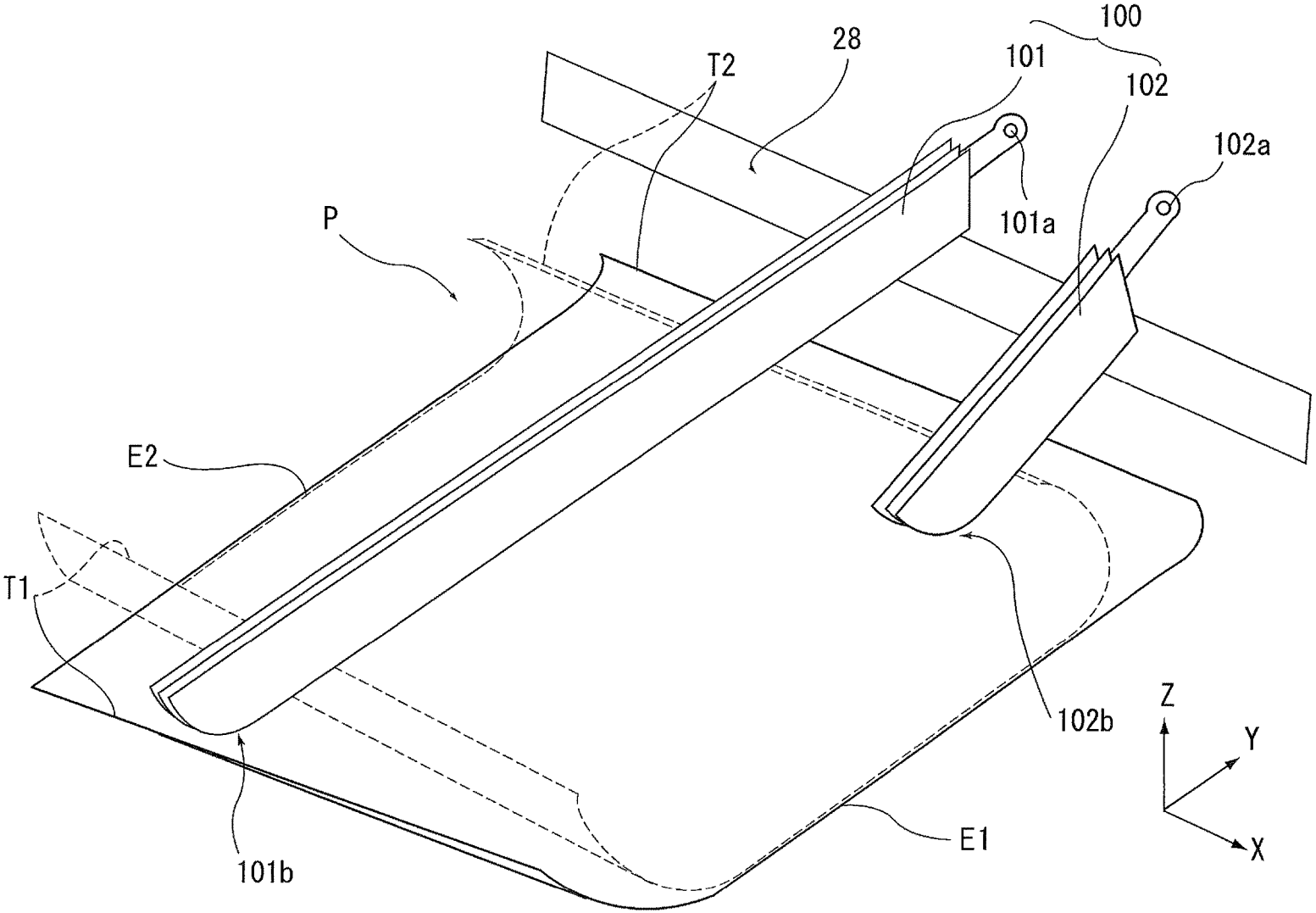
FIG. 8 is a schematic perspective view illustrating a state in which the retainer according to the first embodiment retains the paper.
Figure 9:
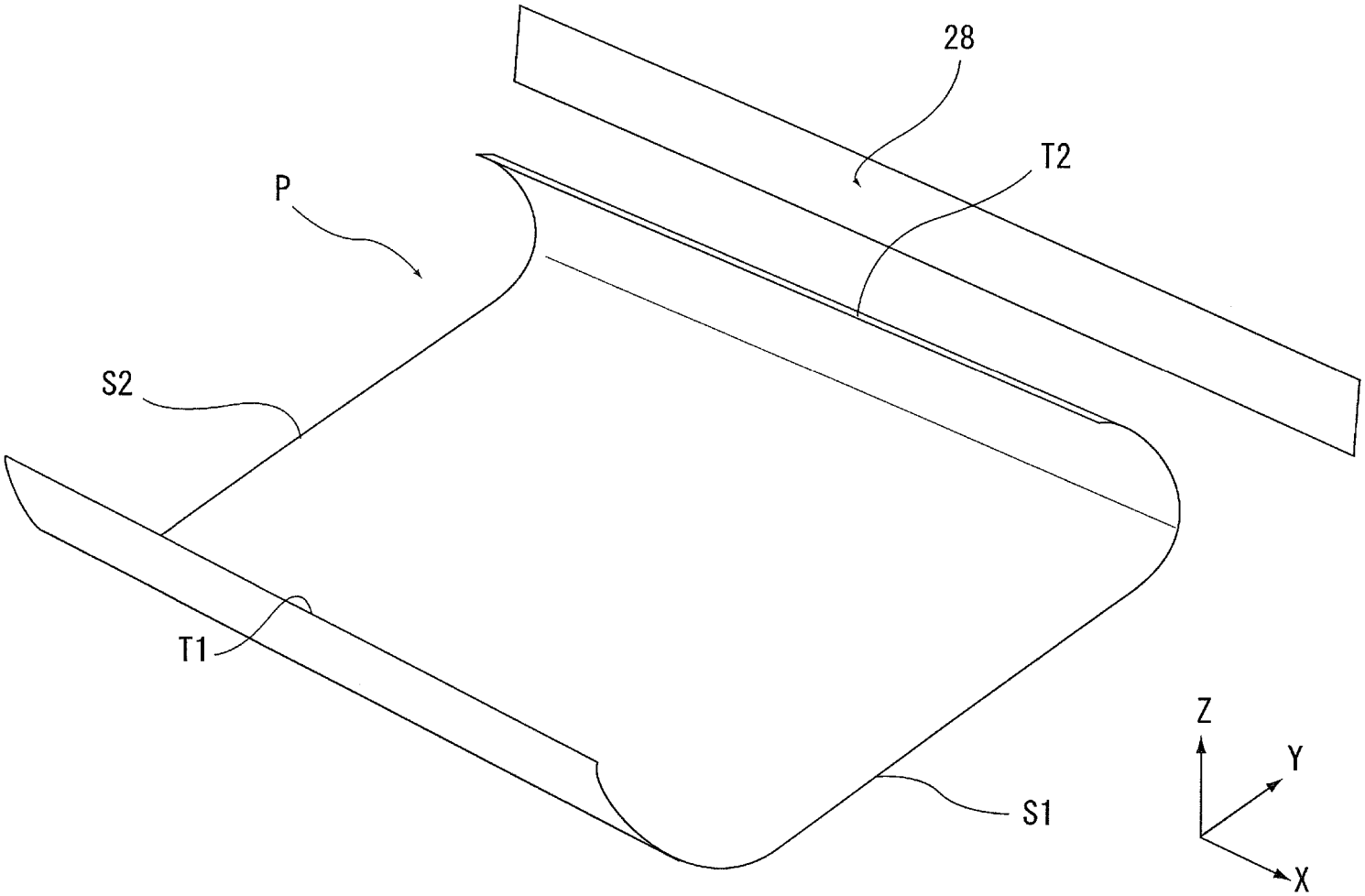
FIG. 9 is a view illustrating a state in which the paper with a latitudinal grain is curled.
Figure 10:
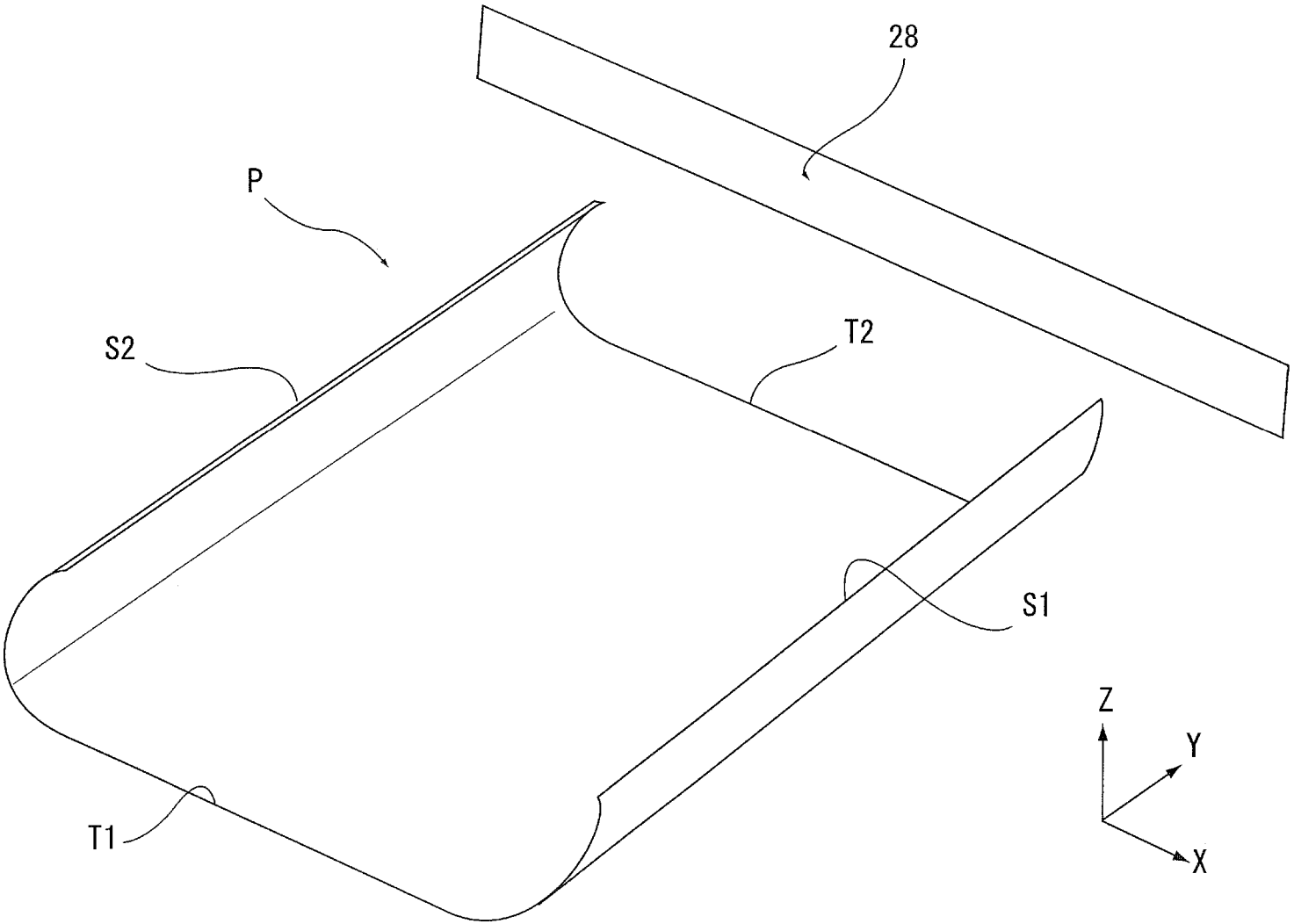
FIG. 10 is a view illustrating a state in which the paper with a longitudinal grain is curled.
Figure 11:
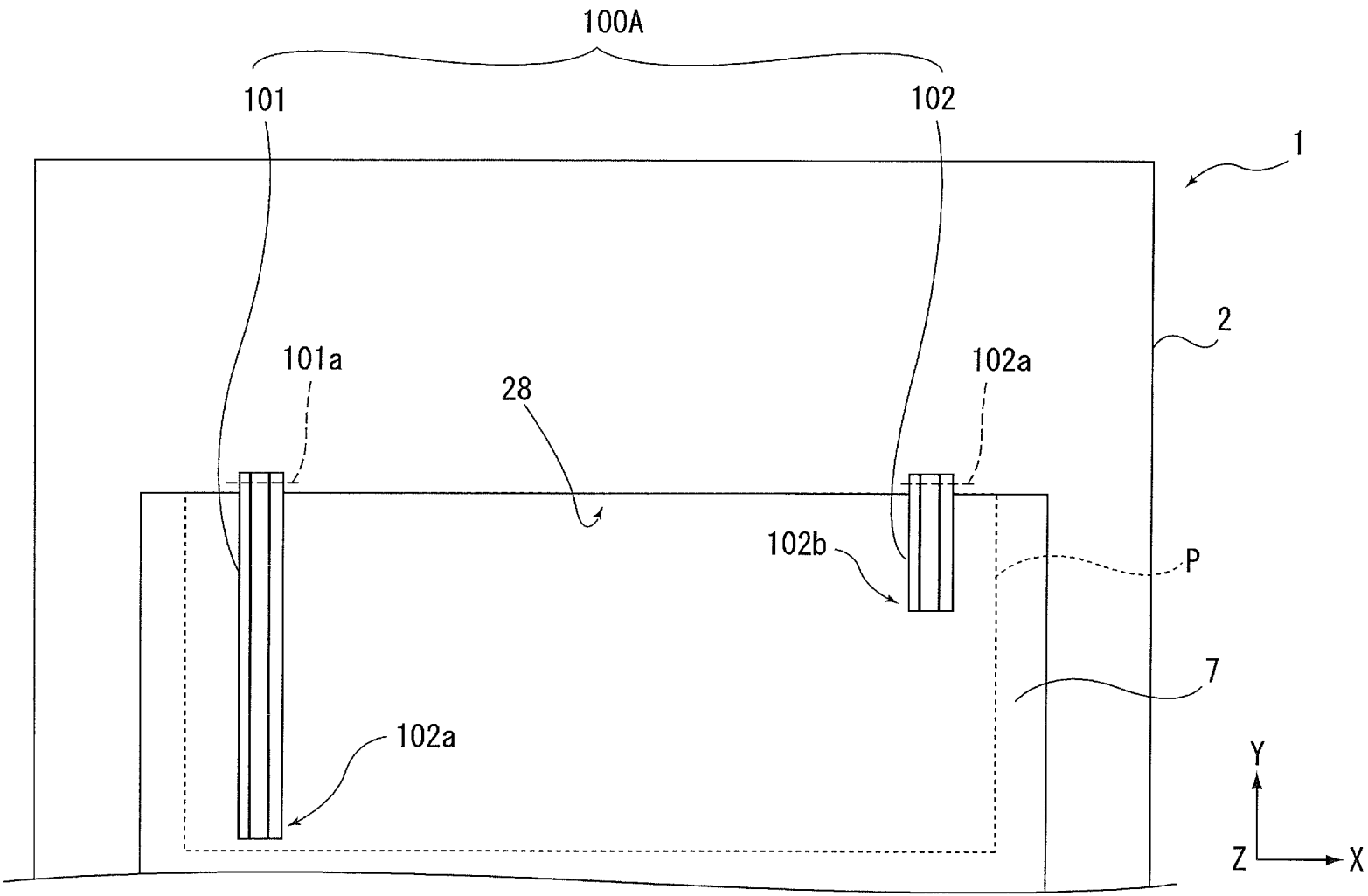
FIG. 11 is a schematic plan view of a retainer according to a modification example of the first embodiment.
Figure 12:
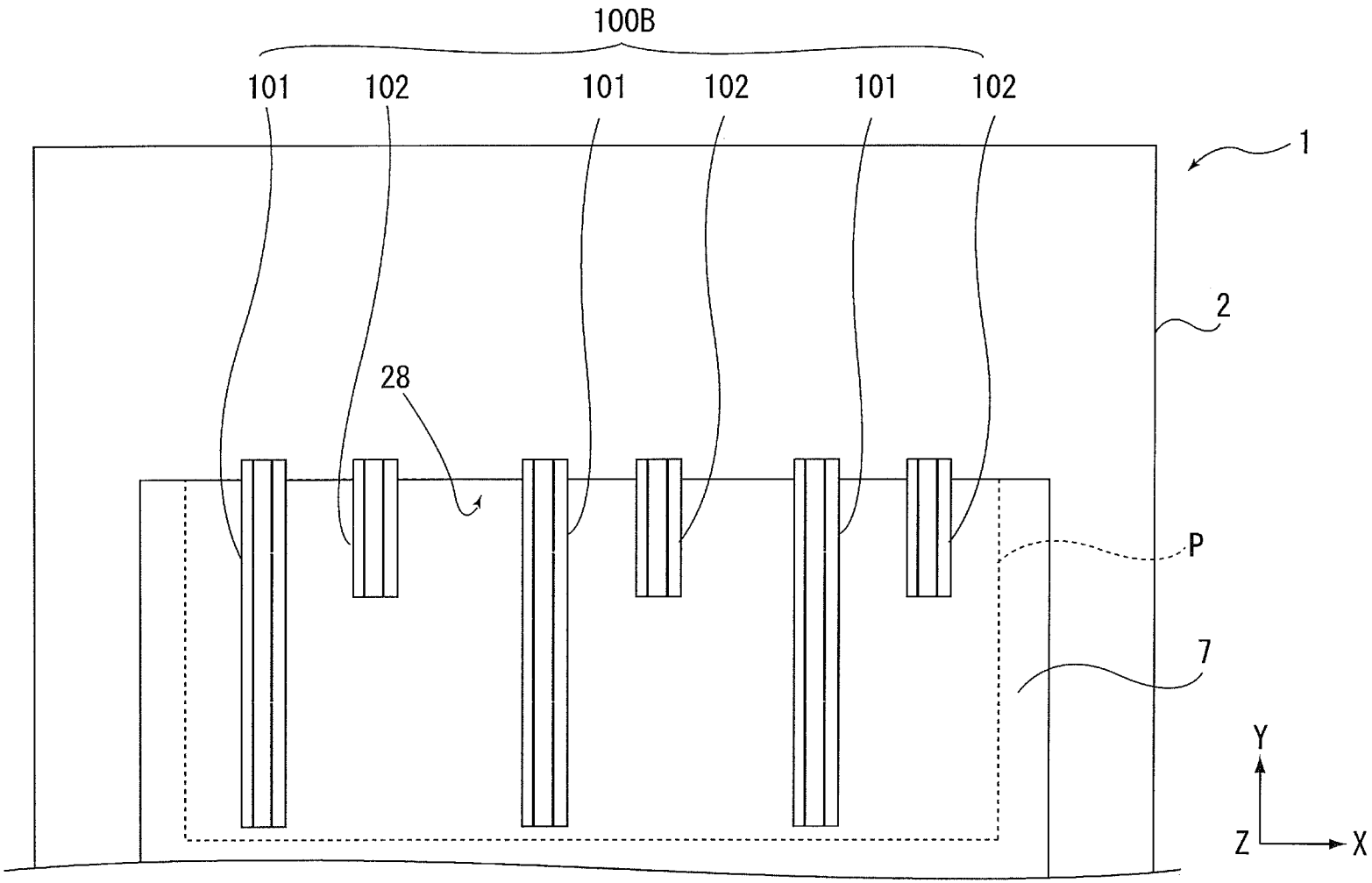
FIG. 12 is a schematic plan view of a retainer according to another modification example of the first embodiment.

FIG. 7 is a schematic plan view of a retainer according to the first embodiment. FIG. 8 is a schematic perspective view illustrating a state in which the retainer according to the first embodiment retains the paper. FIG. 9 is a view illustrating a state in which the paper with a latitudinal grain is curled. FIG. 10 is a view illustrating a state in which the paper with a longitudinal grain is curled. FIG. 11 is a schematic plan view of a retainer according to a modification example of the first embodiment. FIG. 12 is a schematic plan view of a retainer according to another modification example of the first embodiment.

In an X-Y-Z coordinate system illustrated in the drawings, an X-axis direction indicates the width direction of the paper, that is, the apparatus width direction, a Y-axis direction indicates the transport direction (the medium transport direction) of the paper in the transport path inside the recording apparatus, that is, the apparatus depth direction, and a Z-axis direction indicates an apparatus height direction. A direction in which the paper which serves as an example of "the medium" is transported is referred to as downstream and the opposite is referred to as upstream.

Outline of Printer

A description will be given of the overall configuration of the printer 1 with reference to FIG. 1. The printer 1 is configured as a multifunction device which is provided with a housing 2 and a scanner unit 3.

The scanner unit 3 is provided with a scanner main body 4*a* and an ADF unit 4*b*. An operation unit 6 is provided on the +Y direction side end portion of the scanner main body 4*a*. The operation unit 6 is provided with a plurality of operation buttons and a display panel. In the present embodiment, the operation unit 6 is configured such that it is possible to operate a recording action in the printer 1 and an image reading action in the scanner unit 3.

A first paper discharge tray 7 is provided on the top portion of the housing 2. The first paper discharge tray 7 serves as "a placement portion" on which the paper which is discharge from an discharge portion 28 which discharges the paper discharge tray after the recording by a recording unit 13 is placed. In the present embodiment, the first paper discharge tray 7 is configured to receive the medium which is discharge from inside the housing 2 in an inclined posture.

Regarding Medium Transport Path of Printer Regarding Medium Transport Path from Medium Storage Portion to First Paper Discharge Tray A description will be given of a medium transport path S1 (illustrated by a thick solid line in FIG. 2) from a medium storage portion 8 to the first paper discharge tray 7 which are provided in the bottom portion of the housing 2, mainly with reference to FIG. 2.

The medium storage portion 8 is provided on the −Z direction side end portion of the housing 2 in FIG. 2. The medium storage portion 8 is configured to be capable of storing a plurality of sheets of paper. A pickup roller 9 is provided on the +Z direction side of the medium storage portion 8. The pickup roller 9 is configured to be capable of rotational movement using a rotational movement shaft 9*a* as a fulcrum. The pickup roller 9 transports a paper P which is the topmost sheet of the media stored in the medium storage portion 8 to the medium transport direction downstream by coming into contact with the paper P which is stored in the medium storage portion 8.

An inversion roller 10, and driven rollers 11*a*, 11*b*, 11*c*, and 11*d* which are disposed in the periphery of the inversion roller 10 and are driven to rotate with respect to the inversion roller 10 are provided on the downstream of the pickup roller 9.

The paper P which is fed by the pickup roller 9 is inverted by the inversion roller 10 and is fed to a feed roller pair 12 which is provided on the downstream in the medium transport direction. The recording unit 13 is provided on the downstream of the feed roller pair 12 in the medium transport direction.

The recording unit 13 ejects the ink (the liquid) onto the paper to perform the recording on the paper P which is transported. The recording unit 13 is configured to include a carriage 14. The carriage 14 is configured to be capable of moving in the X-axis direction and a recording head 15 which discharges the ink in the −Z direction is provided on the bottom portion of the carriage 14.

The ink which is supplied to the recording unit 13 is configured to be sent from an ink tank 29 (FIG. 1) which is provided on the +X-axis direction side inside the housing 2 via a supply tube (not illustrated).

A medium support unit 16 is provided under the recording head 15 in a region facing the recording head 15. The medium support unit 16 supports the bottom surface (the surface of the opposite side from the recording surface) of the paper P which is transported to the region which faces the recording head 15 by the feed roller pair 12.

The recording head 15 discharges the ink onto the paper P which is supported by the medium support unit 16 and executes the recording onto the recording surface of the paper P.

An discharge roller pair 17 is provided on the downstream of the recording head 15 in the medium transport direction. As illustrated in FIG. 4, the discharge roller pair 17 is provided with an discharge drive roller 17*a* and an discharge serrated roller 17*b* which is driven to rotate by the output drive roller 17*a* and includes a plurality of teeth on the outer circumference. The discharge drive roller 17*a* is driven by a motor (not illustrated). The discharge roller pair 17 is provided between the recording unit 13 and an upstream side roller pair 18 (described later) and transports the paper.

A curved path 20 which curves and inverts the paper is provided on the downstream of the discharge roller pair 17 in the medium transport direction.

The upstream side roller pair 18 which transports the paper which is fed from the discharge roller pair 17 to the curved path 20 is provided on the upstream of the curved path 20 in the medium transport direction. As illustrated in FIG. 4, the upstream side roller pair 18 is provided with an upstream side drive roller 18*a* and an upstream side serrated roller 18*b* which is driven to rotate by the upstream side drive roller 18*a* and includes a plurality of teeth on the outer circumference.

A downstream side roller pair 19 which discharges the paper from the curved path 20 is provided on the downstream of the curved path 20 in the medium transport direction. As illustrated in FIG. 4, the downstream side roller pair 19 is provided with a downstream side drive roller 19*a* and a downstream side serrated roller 19*b* which is driven to rotate by the downstream side drive roller 19*a* and includes a plurality of teeth on the outer circumference.

The upstream side drive roller 18*a* and the downstream side drive roller 19*a* are driven by a motor (not illustrated). It is possible to adopt a configuration in which the driving of the upstream side drive roller 18*a* and the downstream side drive roller 19*a* receives the motive force from the motor which drives the discharge drive roller 17*a*.

The paper which is discharge from the curved path 20 and is discharge from the discharge portion 28 by the downstream side roller pair 19 is placed on the first paper discharge tray 7. That is, the curved path 20 is positioned on the upstream of the discharge portion 28 in the medium discharge direction.

The curved path 20 illustrated in FIG. 2 (also refer to FIG. 4) is configured to include an outside curved portion 20*a* and an inside curved portion 20*b*. The paper which is transported passes between the inside curved portion 20*b* and the outside curved portion 20*a* and is curved and inverted.

That is, in the printer 1, the paper is placed on the first paper discharge tray 7 in a so-called face-down system in which the recording surface of the paper faces downward.

A retainer 100 which retains the paper P toward the first paper discharge tray 7 is provided in the vicinity of the exit of the discharge portion 28 on the downstream of the discharge portion 28 in the medium discharge direction.

In the printer 1 in which the paper is mounted, using a face-down system, on the first paper discharge tray 7 after being recorded on, the paper P may curl after being discharge from the discharge portion 28 with the top surface on the inside, as illustrated in FIG. 9 or FIG. 10. The paper P which is curled in this manner easily blocks the discharge portion 28. However, it is possible to retain the paper P using the retainer 100 and increase the stacking properties of the paper P on the first paper discharge tray 7. A detailed description will be given later of the specific configuration of the retainer 100.

In the present embodiment, a support portion 25 which supports the paper is provided on the downstream side of the upstream side roller pair 18 in the medium transport direction. The support portion 25 is configured to be capable of being displaced between a first state in which the support portion 25 serves as a path from the upstream side roller pair 18 toward the curved path 20 as illustrated in FIG. 2, and a second state in which the support portion 25 serves as a path toward a different transport destination (discharge portion) from the first paper discharge tray 7 as illustrated in FIG. 4. A description will be given later of the discharging of the paper to the support portion 25 after describing the transporting of the paper from a rear side feed unit 21 below.

Regarding Medium Transport Path from Rear Side Feed Unit to First Paper Discharge Tray Next, a description will be given of the transporting of the paper from the rear side feed unit 21 in FIG. 3. The rear side feed unit 21 is provided on the −Y direction side end portion of the housing 2. The rear side feed unit 21 is provided with a feed port cover 22. The feed port cover 22 is configured to be capable of rotational movement with respect to the housing 2 and is capable of switching between a closed state (FIG. 2) and an open state (FIG. 3). By adopting the state in which the feed port cover 22 is open, it is possible to feed the paper from the rear side feed unit 21 toward the recording unit 13 inside the housing 2. In FIG. 3, the medium transport path of the paper P which is fed from the rear side feed unit 21 is represented by a thick line indicated by a reference numeral S2.

A feed roller 23 and a separation roller 24 are provided on the downstream of the feed port cover 22. The medium which is set in the rear side feed unit 21 is nipped by the feed roller 23 and the separation roller 24, is transported, and meets the medium transport path S1 from the medium storage portion 8 which is described earlier on the upstream of the feed roller pair 12. Subsequently, in the same manner as the medium transport path S1 illustrated in FIG. 2, the paper is fed to the recording unit 13, the recording is performed, and the paper passes the curved path 20 to be discharge to the first paper discharge tray 7.

Regarding Paper Discharge to Second Paper Discharge Tray (Support Portion)

As described earlier, in addition to discharging the paper to the first paper output tray 7 after the recording by the recording unit 13 is performed, as illustrated in FIG. 4, the printer 1 is capable of discharging the paper using the support portion 25 which is disposed on the +Y direction side of the housing 2 as the second paper discharge tray. In FIG. 4, the thick line indicated by a reference numeral S3 illustrates the medium transport path in which the paper is discharge to the support portion 25 in the second state (described later).

The support portion 25 is provided with a rotational movement shaft 25*a* and transitions from the first state (FIG. 2) in which the support portion 25 serves as a path of a case in which the paper passes through the curved path 20 and is discharge to the first paper discharge tray 7 after the recording to the second state (FIG. 4) in which the support portion 25 rocks centered on the rotational movement shaft 25*a* and the transport destination is different from the first paper discharge tray 7.

A first cover 26 is provided on the side surface of the housing 2 illustrated in FIG. 1 on the +Y direction side, that is, the front surface. The first cover 26 is provided to be capable of opening and closing with respect to the housing 2. FIGS. 4 to 6 illustrate a state in which the first cover 26 is open. The first cover 26 is configured to use the bottom end portion side of the housing 2 as a rotational movement fulcrum and the +Z direction side end portion of the first cover 26 is configured as a free end.

As illustrated in FIGS. 5 and 6, when the first cover 26 is set to the open state, a portion of the support portion 25 and the medium storage portion 8 is exposed. In the state in which the first cover 26 is open, it is possible to pull out a portion of the medium storage portion 8 to the +Y direction side of the housing 2, and it is possible to facilitate the supplying of the medium to the medium storage portion 8.

In FIG. 5, the support portion 25 is in the second state (the state of FIG. 4), and in FIG. 6, the support portion 25 is in the first state (the state of FIGS. 2 and 3).

When the first cover 26 is opened and the support portion 25 is set to the second state (the state of FIGS. 4 and 5), the paper is fed by the discharge roller pair 17 and the upstream side roller pair 18 after the recording is performed by the recording unit 13, and the paper is discharge from the apparatus front side (the +Y direction side) of the housing 2 while being supported by the support portion 25 which is in the second state.

In FIG. 1, a second cover 27 is provided above the first cover 26. Although not illustrated in the drawings, when the second cover 27 is opened, the outside curved portion 20*a* and the inside curved portion 20*b* are exposed and it is possible to perform processing of paper jamming and the like in the curved path 20.

Regarding Retaining Portion

A description will be given of the retainer 100 with reference to FIGS. 4 and 7.

The retainer 100 is configured to include a plurality of retaining portions which retains the paper toward the first paper discharge tray 7 on the downstream of the discharge portion 28 in the medium discharge direction.

In the present embodiment, as illustrated in FIG. 4, the retainer 100 is provided with a first retaining portion 101 and a second retaining portion 102 which retains closer to the upstream in the medium discharge direction (the −Y direction side) than a retaining position 101*b* of the first retaining portion 101.

In other words, a retaining position 102*b* of the second retaining portion 102 is closer to the upstream in the medium discharge direction (the −Y direction side) than the retaining position 101*b* of the first retaining portion 101.

By including the first retaining portion 101 and the second retaining portion 102 which retains the retaining position 102*b* which is closer to the upstream in the medium discharge direction (the −Y direction side) than the retaining position 101*b* of the first retaining portion 101, the retainer 100 is capable of retaining, for example, as illustrated in FIG. 9, the paper P which curls in the medium discharge direction (for example, a case in which the paper P is discharge with a latitudinal grain) at the retaining position 101*b* and the retaining position 102*b* which are deviated from each other in the medium discharge direction (the Y-axis direction) as illustrated in FIG. 8. Therefore, it is possible to maintain favorable stacking properties of the paper P in the first paper discharge tray 7.

In the present embodiment, the first retaining portion 101 and the second retaining portion 102 are provided at positions which retain a center region of the paper P in the width direction (the X-axis direction) which intersects the medium discharge direction as illustrated in FIG. 7. In FIG. 7, a reference numeral C is a center portion of the first paper discharge tray 7 in the width direction. In the present embodiment, a position closer to the center portion C than side edges 7*a* and 7*b* of the first paper discharge tray 7 is the center region.

Since the printer 1 of the present embodiment is configured to be capable of feeding the paper P of a plurality of sizes and to feed paper using a center feeding system, the center portion C of the first paper discharge tray 7 in the width direction matches the center portion of the paper P each size in the width direction. In other words, it is also possible to retain the center region in the width direction with respect to the paper P of any size.

As illustrated in FIG. 4, the first retaining portion 101 and the second retaining portion 102 are respectively provided with a rotational movement shaft 101*a* and a rotational movement shaft 102*a* on the top portion of the discharge portion 28 and are configured to be capable of rocking so as to proceed and withdraw with respect to the paper P on the first paper discharge tray 7. The free end (the end portion on the −Y direction side in FIG. 4) which proceeds and withdraws with respect to the paper P is configured to retain the paper P (also refer to FIG. 8).

Due to the first retaining portion 101 and the second retaining portion 102 being capable of rocking, the first retaining portion 101 and the second retaining portion 102 are capable of being pushed by the paper which is discharge and escaping in the withdrawal direction which separates from the paper. Therefore, it is possible to reduce the concern of the pressing force of each of the retaining portions from excessively being applied to the paper P.

In FIG. 4, the first retaining portion 101 and the second retaining portion 102 are in a state of being lowered by the weight of the first retaining portion 101 and the second retaining portion 102 themselves. In the present embodiment, the first retaining portion 101 and the second retaining portion 102 are configured to retain the paper using the weight of the first retaining portion 101 and the second retaining portion 102 themselves. Naturally, it is possible to configure the first retaining portion 101 and the second retaining portion 102 to be pressed toward the first paper discharge tray by a pressing member such as a spring.

Modification Example of First Embodiment

Modification Example 1-1

In a retainer 100A which serves as a modification example of the first embodiment, as illustrated in FIG. 11, the first retaining portion 101 and the second retaining portion 102 are provided to leave a larger interval in the width direction than in the retainer 100 illustrated in FIG. 7.

In a case in which the paper P has a longitudinal grain in which the grain goes along the medium transport direction, as illustrated in FIG. 10, there is a case in which the paper P curls in the width direction which intersects the medium transport direction after the recording. In other words, there is a case in which the paper P curls such that the side edges E1 and E2 of the paper P face upward.

In the retainer 100A, due to the first retaining portion 101 and the second retaining portion 102 being disposed as illustrated in FIG. 11, in addition to the first retaining portion 101 and the second retaining portion 102 suppressing the curling in the medium discharge direction (for example, a case in which the paper P is discharge with a latitudinal grain) as with the paper P illustrated in FIG. 9 with respect to the paper of a predetermined size, it is also possible to suppress the curling in the width direction (for example, the medium which is discharge with a longitudinal grain) as illustrated in FIG. 10.

Modification Example 1-2

As illustrated in FIG. 12, in a retainer 100B which serves as another modification example of the first embodiment, the first retaining portions 101 and the second retaining portions 102 are provided alternately. Accordingly, it is possible to more reliably retain the curling of the paper P.

Although not illustrated in the drawings, the configuration is not limited to a case in which the disposition of the first retaining portions 101 and the second retaining portions 102 in the width direction is such that the first retaining portions 101 and the second retaining portions 102 are disposed alternately one by one. For example, a configuration may be adopted in which two or more of the second retaining portions 102 are disposed between one first retaining portion 101 and another. Conversely, a configuration may be adopted in which two or more of the first retaining portions 101 are disposed between one second retaining portion 102 and another.

Second Embodiment

In the second embodiment, a description will be given of another embodiment of the retainer based mainly on FIGS. 13 to 25. The drawings which are used in the description of the first embodiment will also be referenced where appropriate.

Figure 13:
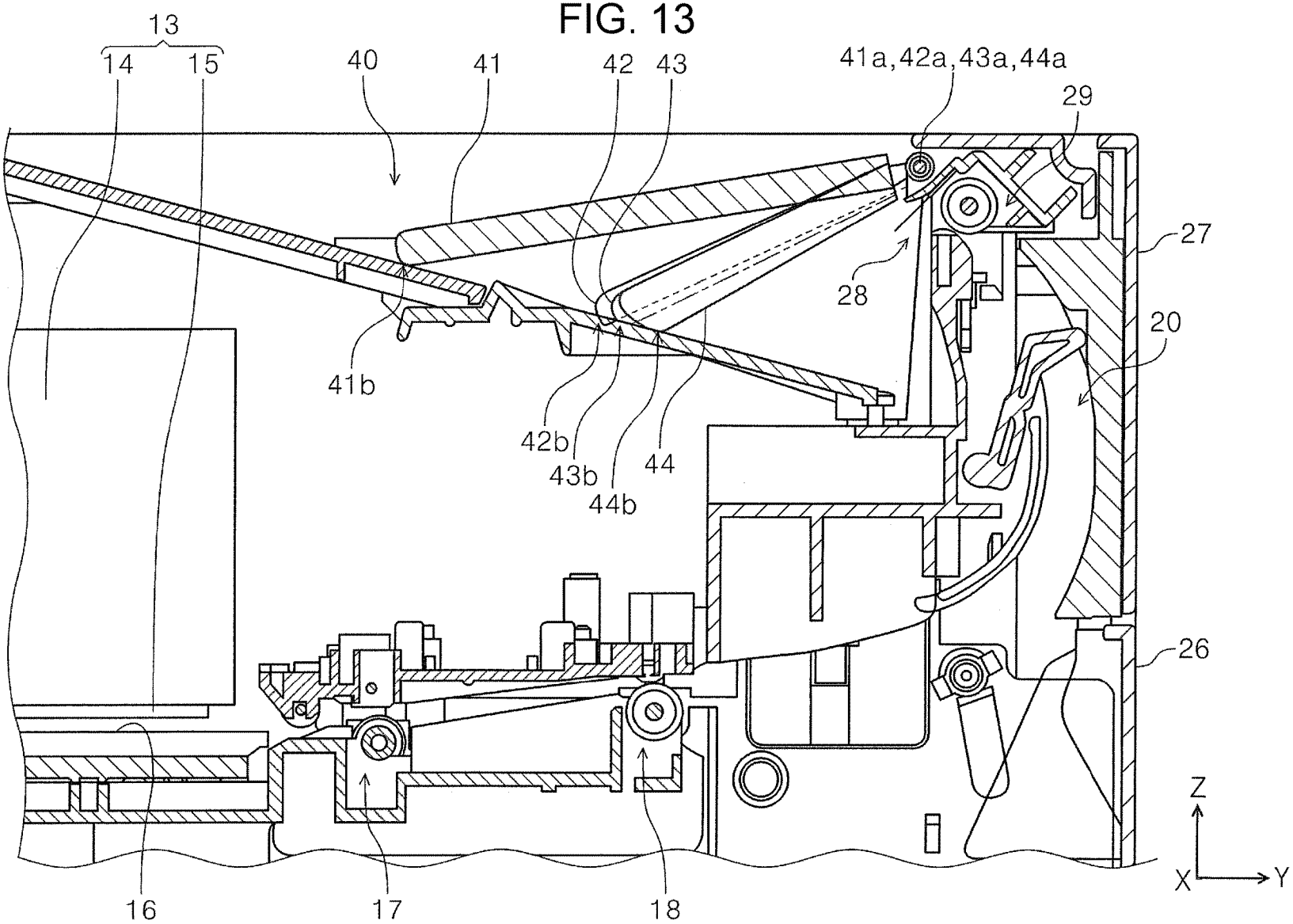
FIG. 13 is a sectional diagram of the main parts of a printer according to a second embodiment.
Figure 14:
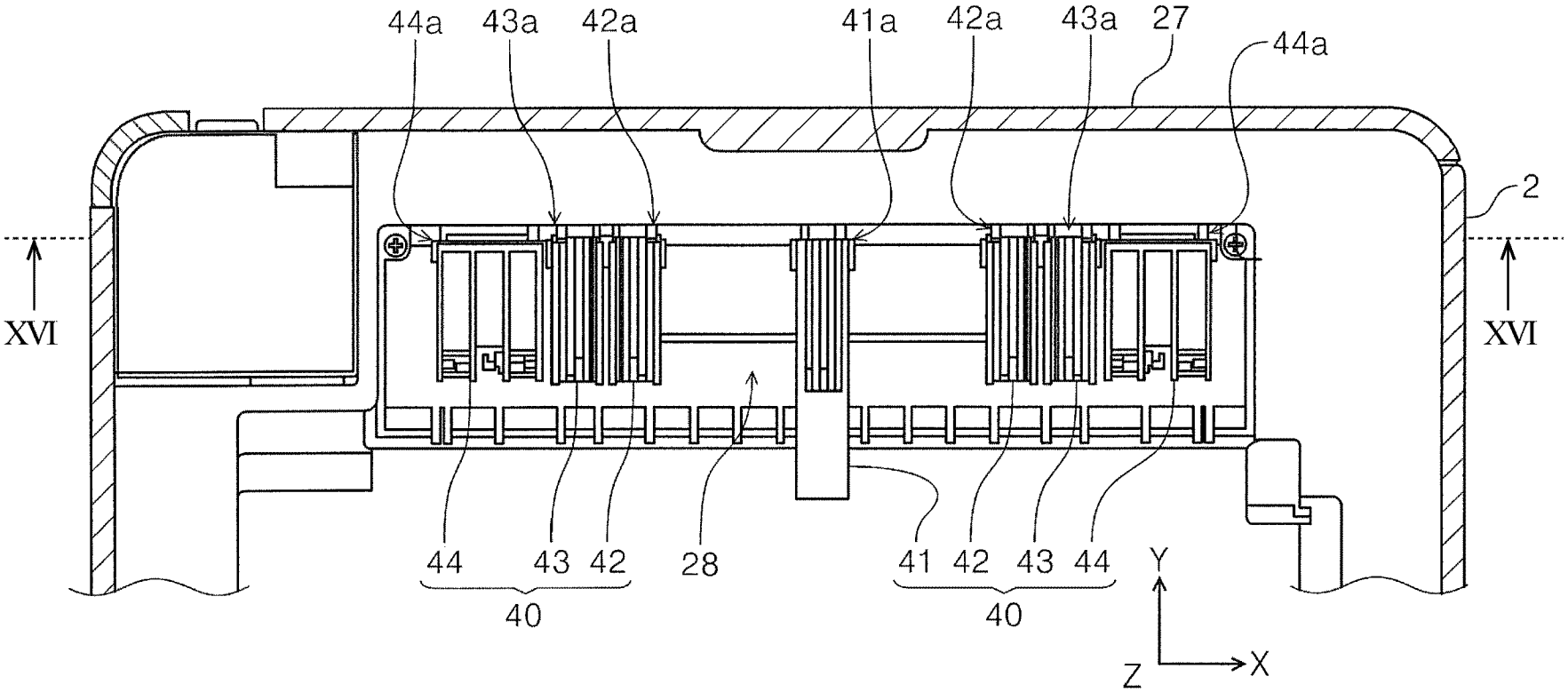
FIG. 14 is a plan view of a retainer according to the second embodiment.
Figure 15:
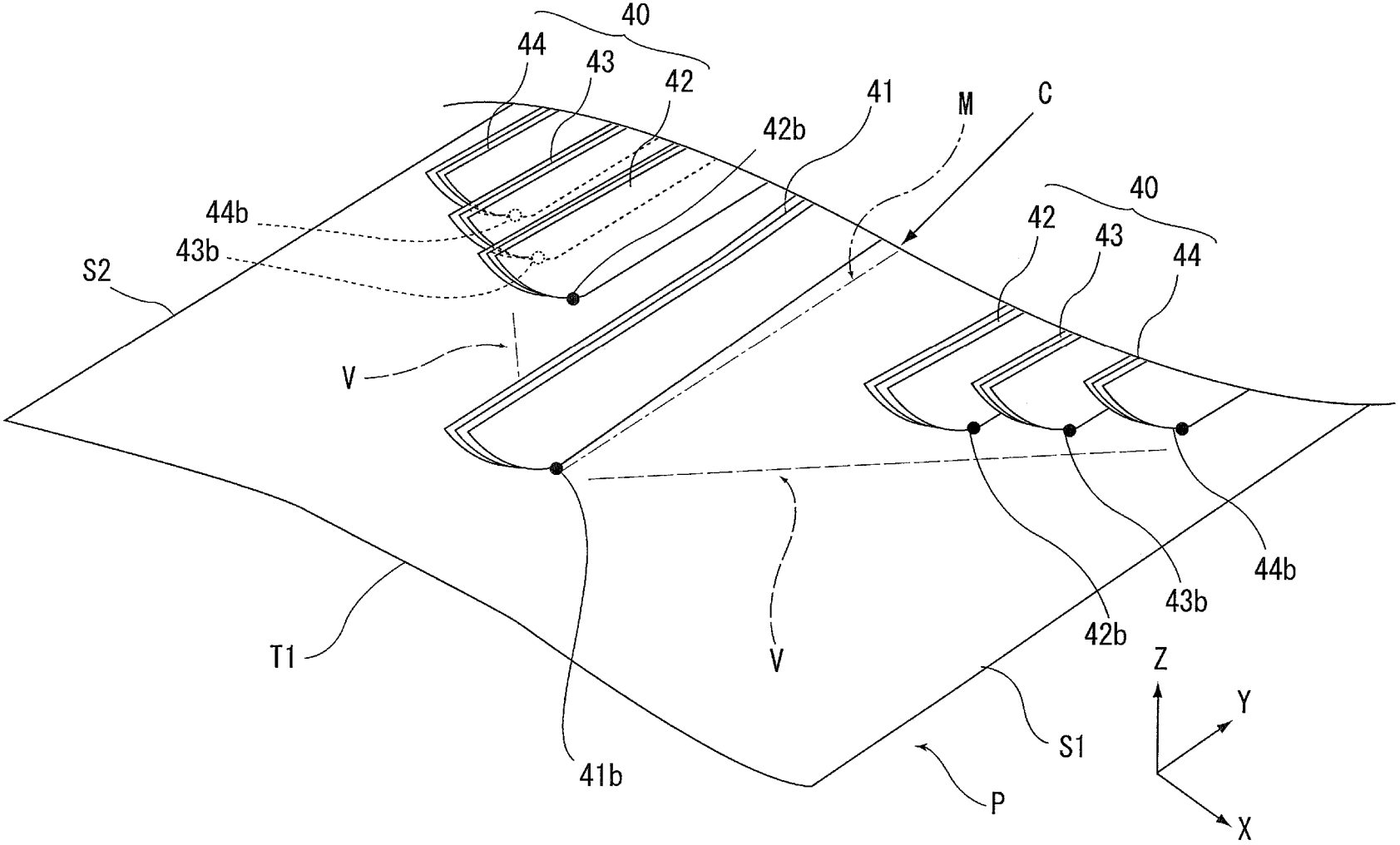
FIG. 15 is a view illustrating a state in which the retainer according to the second embodiment retains the paper.
Figure 16:
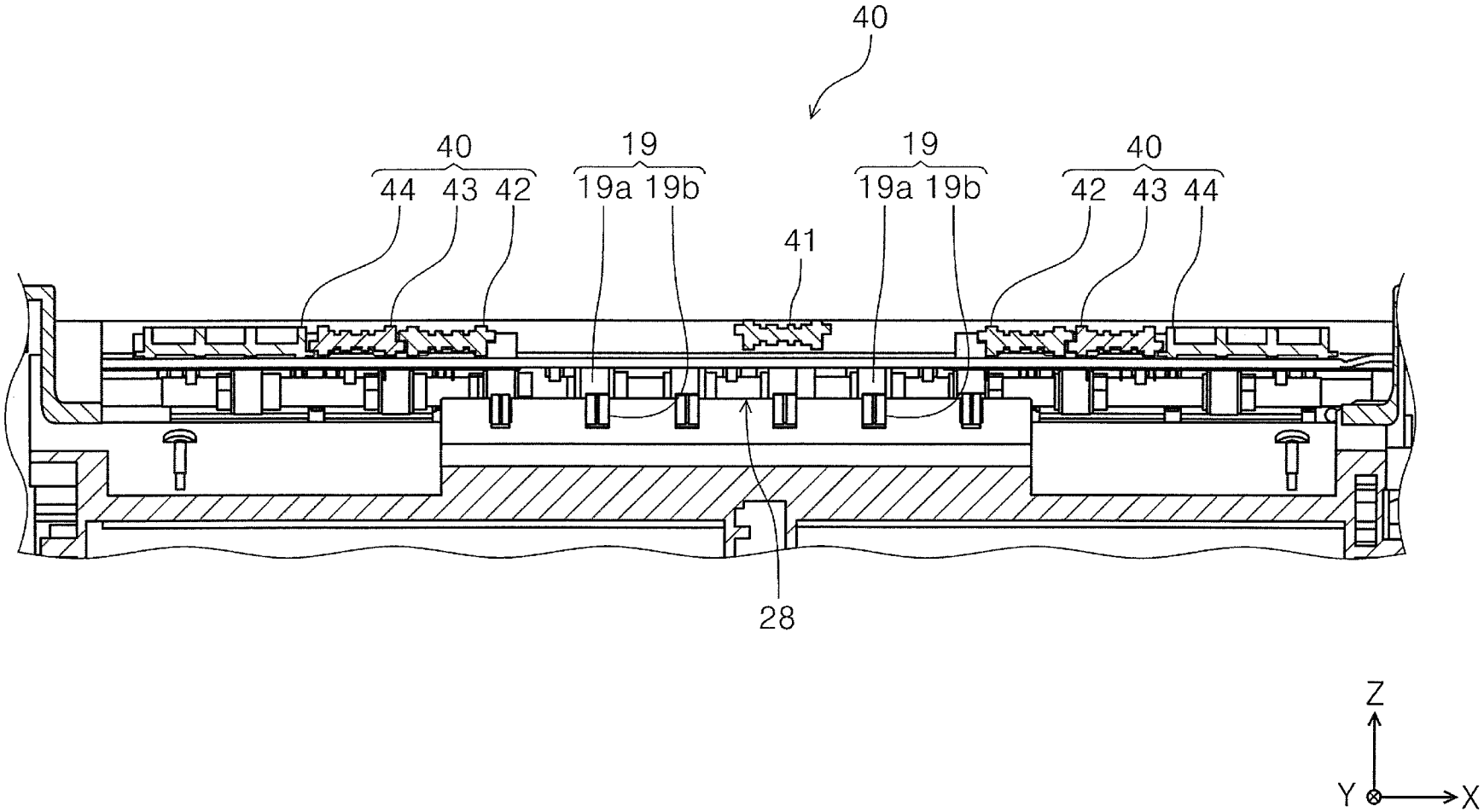
FIG. 16 is a sectional diagram taken along XVI-XVI of FIG. 14.
Figure 17:
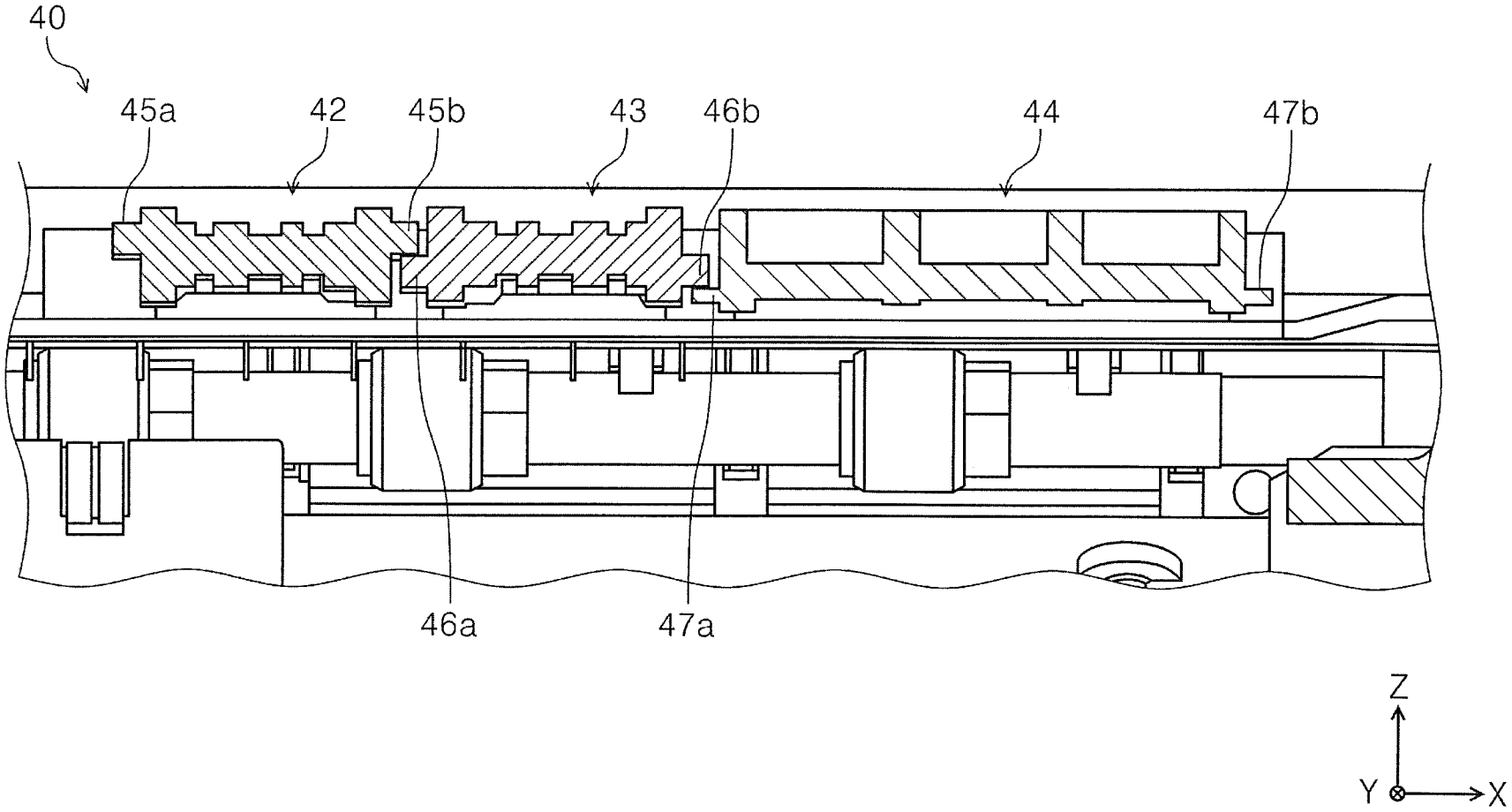
FIG. 17 is an enlarged view of the main parts of FIG. 16.
Figure 18:
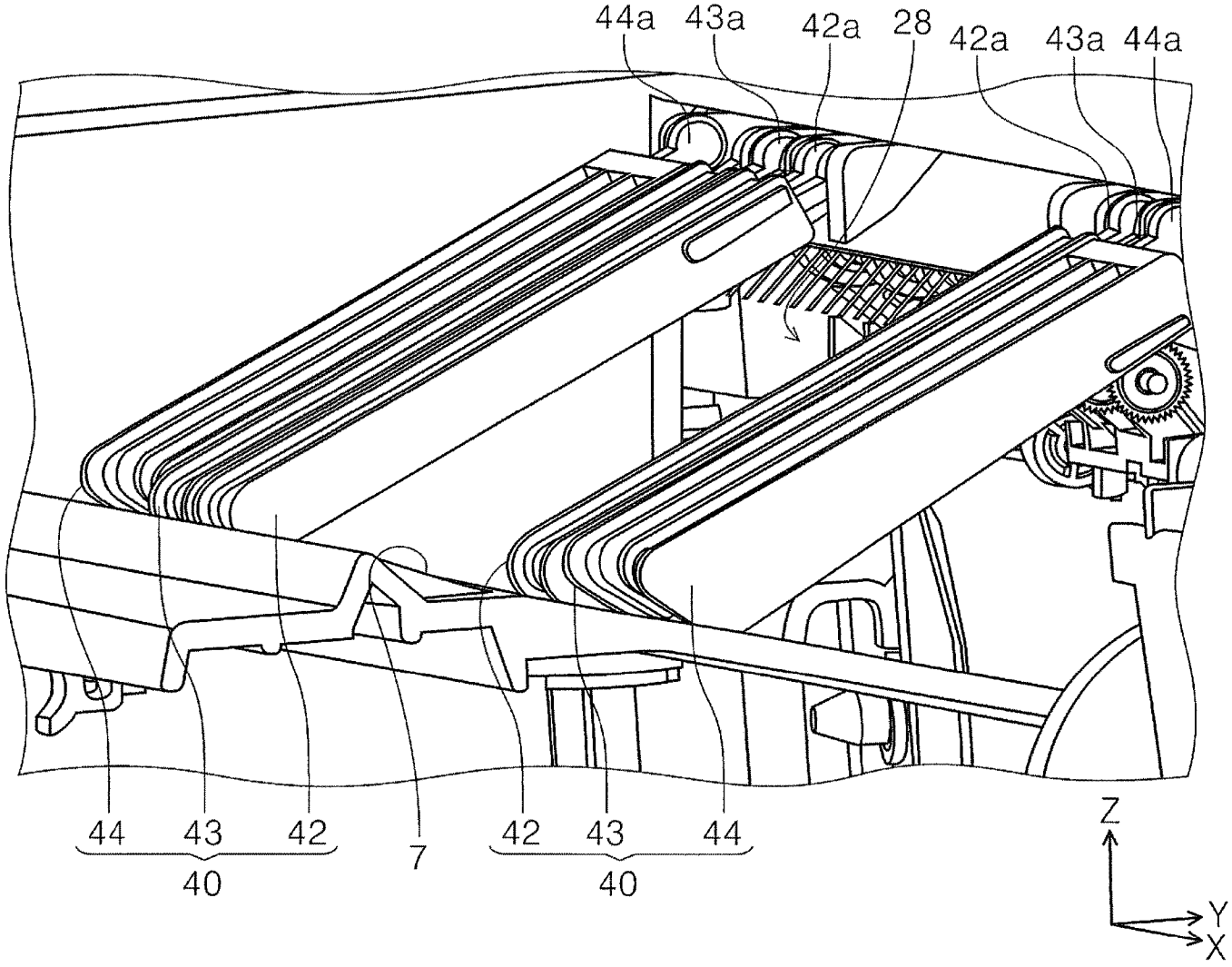
FIG. 18 is a perspective view of the retainer according to the second embodiment.
Figure 19:
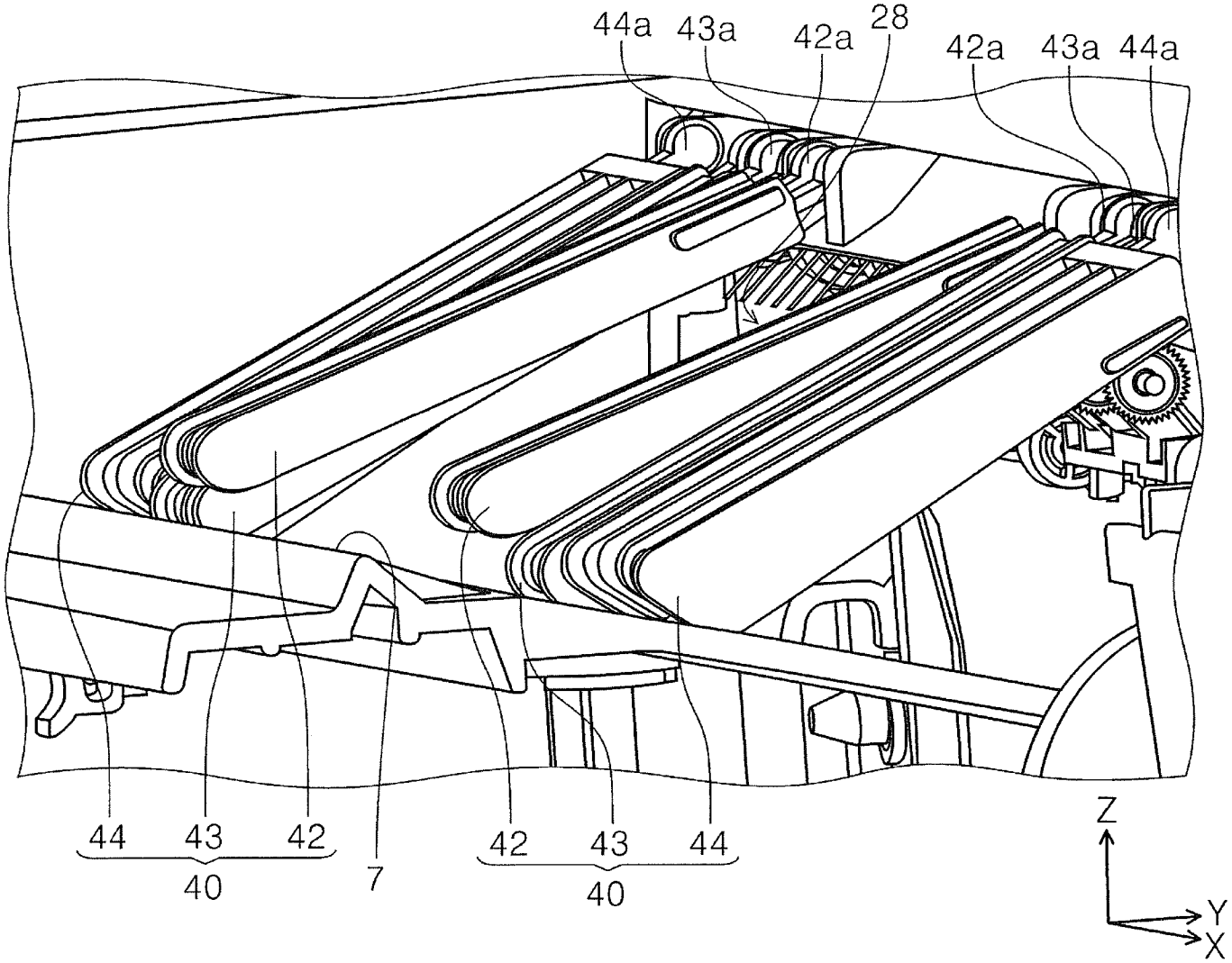
FIG. 19 is a perspective view illustrating a state in which a second retaining portion rocks upward in the retainer.

FIG. 13 is a sectional diagram of the main parts of a printer according to a second embodiment. FIG. 14 is a plan view of a retainer according to the second embodiment. FIG. 15 is a view illustrating a state in which the retainer according to the second embodiment retains the paper. FIG. 16 is a sectional diagram taken along XVI-XVI of FIG. 14. FIG. 17 is an enlarged view of the main parts of FIG. 16. FIG. 18 is a perspective view of the retainer according to the second embodiment. FIG. 19 is a perspective view illustrating a state in which a second retaining portion rocks upward in the retainer.

Figure 20:
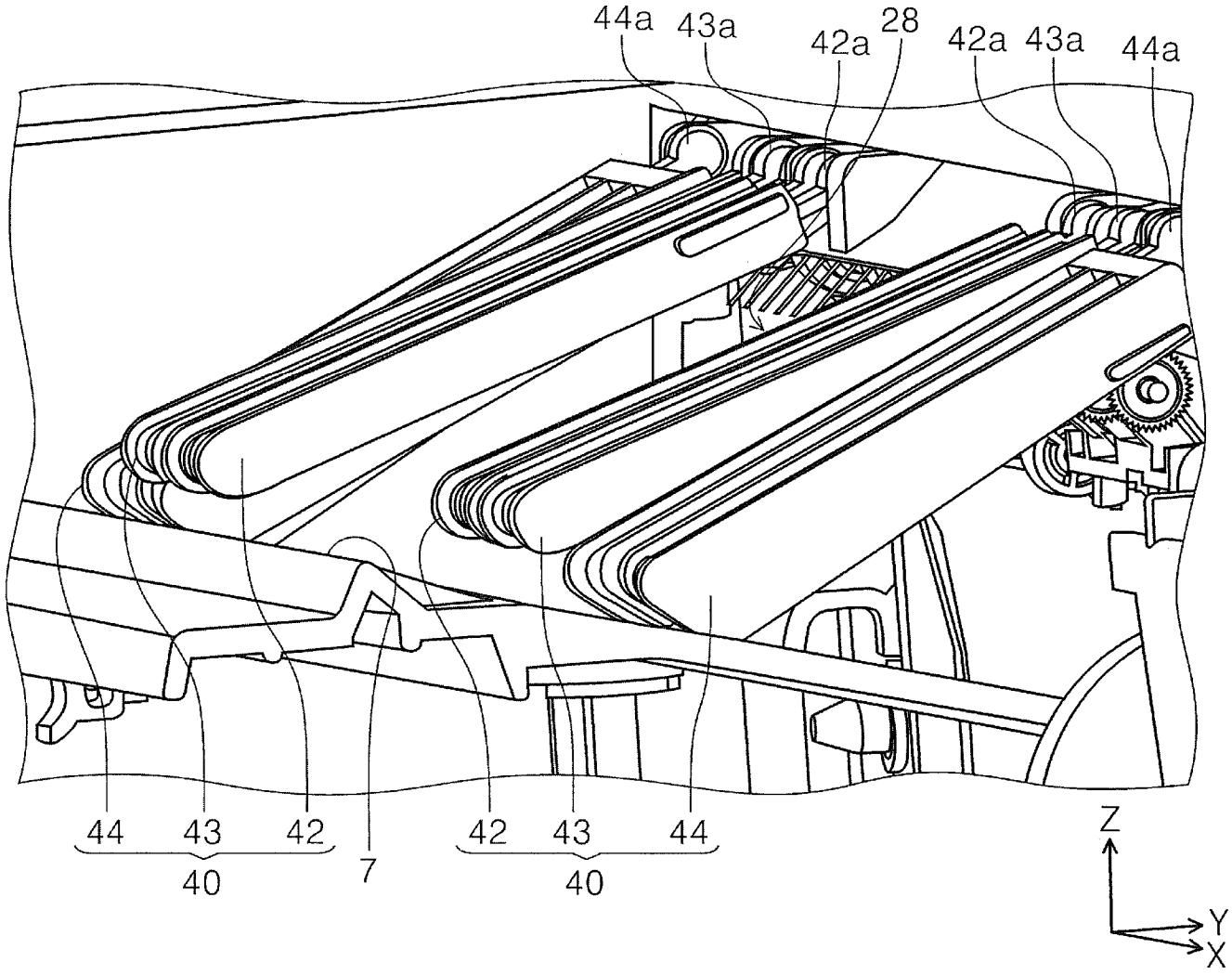
FIG. 20 is a perspective view illustrating a state in which the second retaining portion and a third retaining portion rock upward in the retainer.
Figure 21:
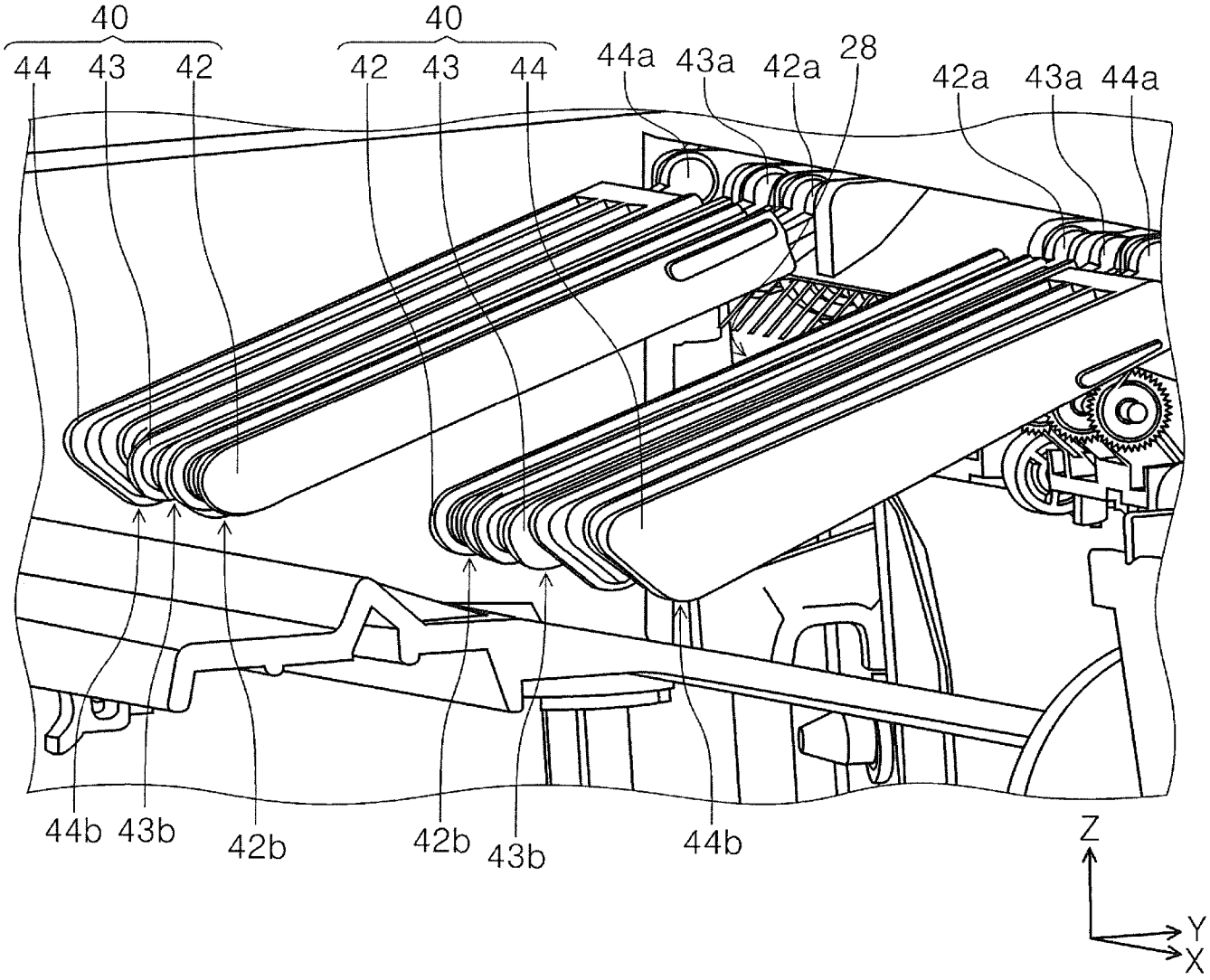
FIG. 21 is a perspective view illustrating a state in which the second, third, and fourth retaining portions rock upward in the retainer.
Figure 22:
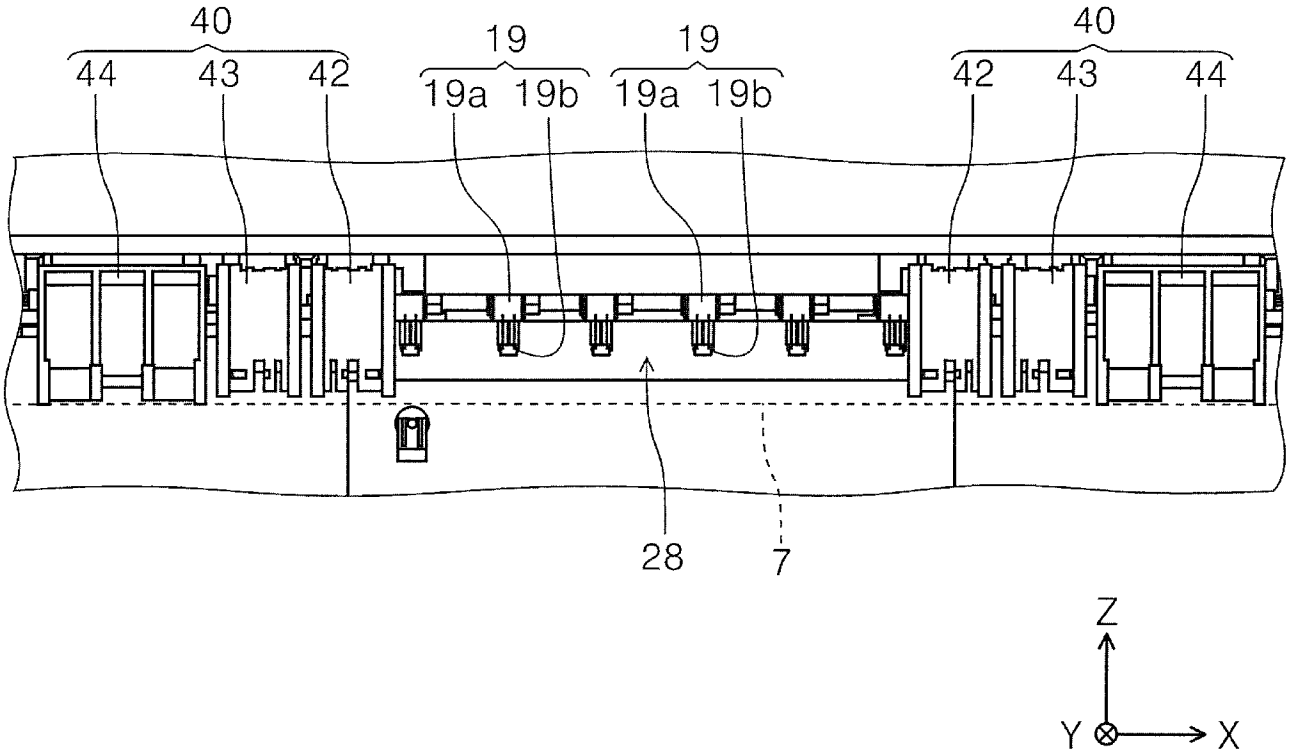
FIG. 22 is a view of FIG. 18 as viewed from a −Y direction side toward a +Y direction.
Figure 23:
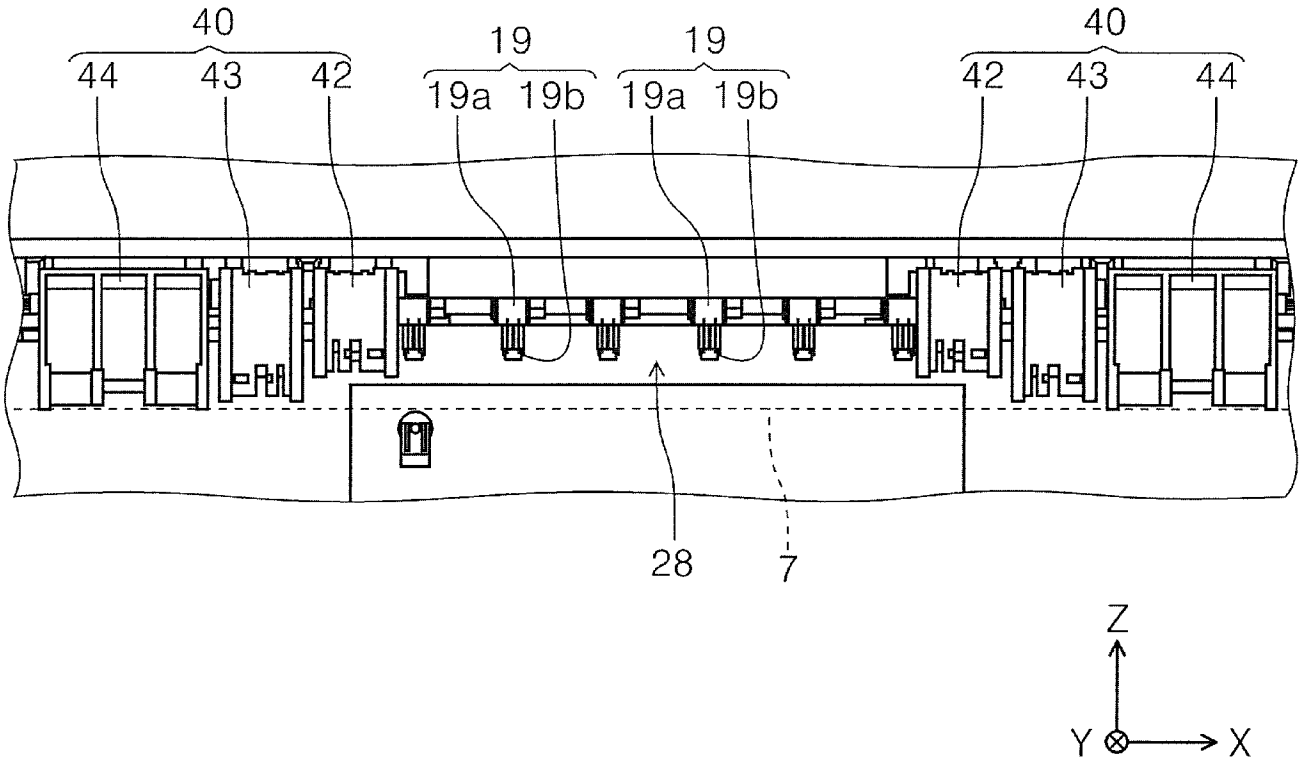
FIG. 23 is a view of FIG. 19 as viewed from the −Y direction side toward the +Y direction.
Figure 24:
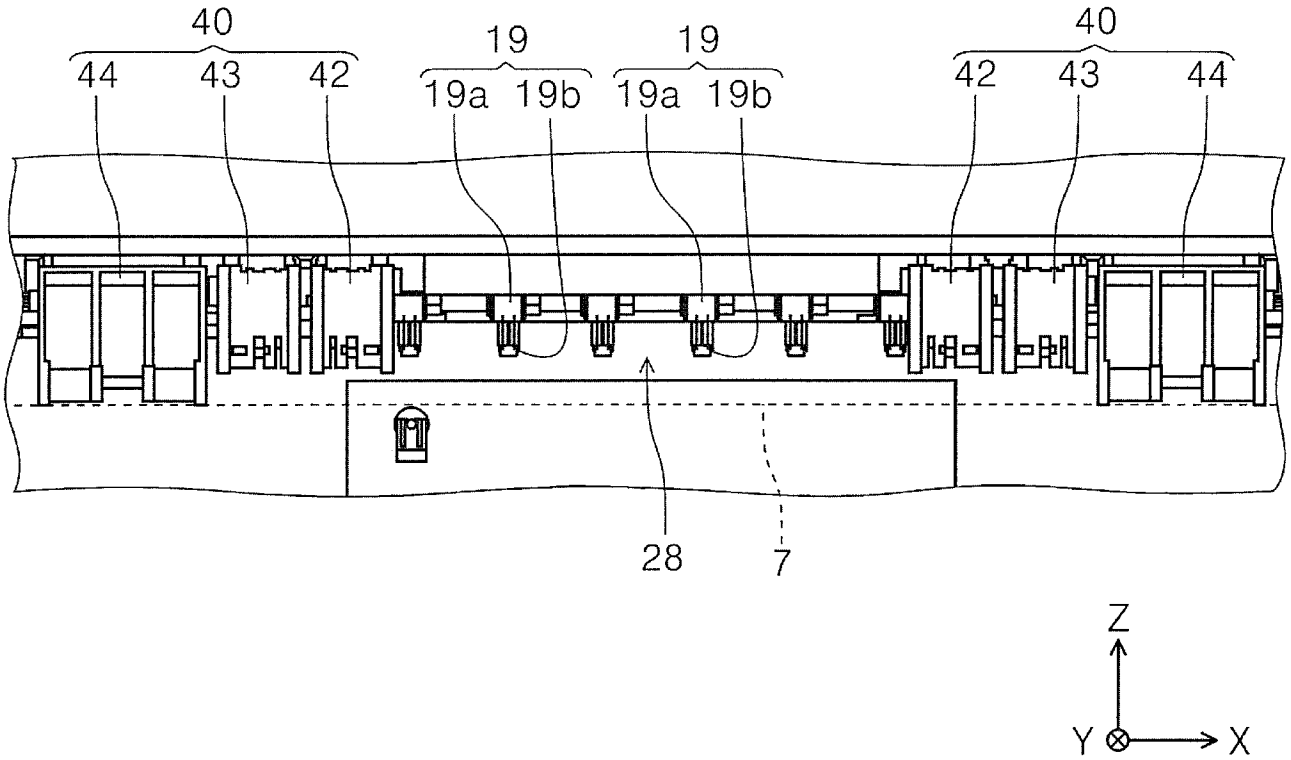
FIG. 24 is a view of FIG. 20 as viewed from the −Y direction side toward the +Y direction.
Figure 25:
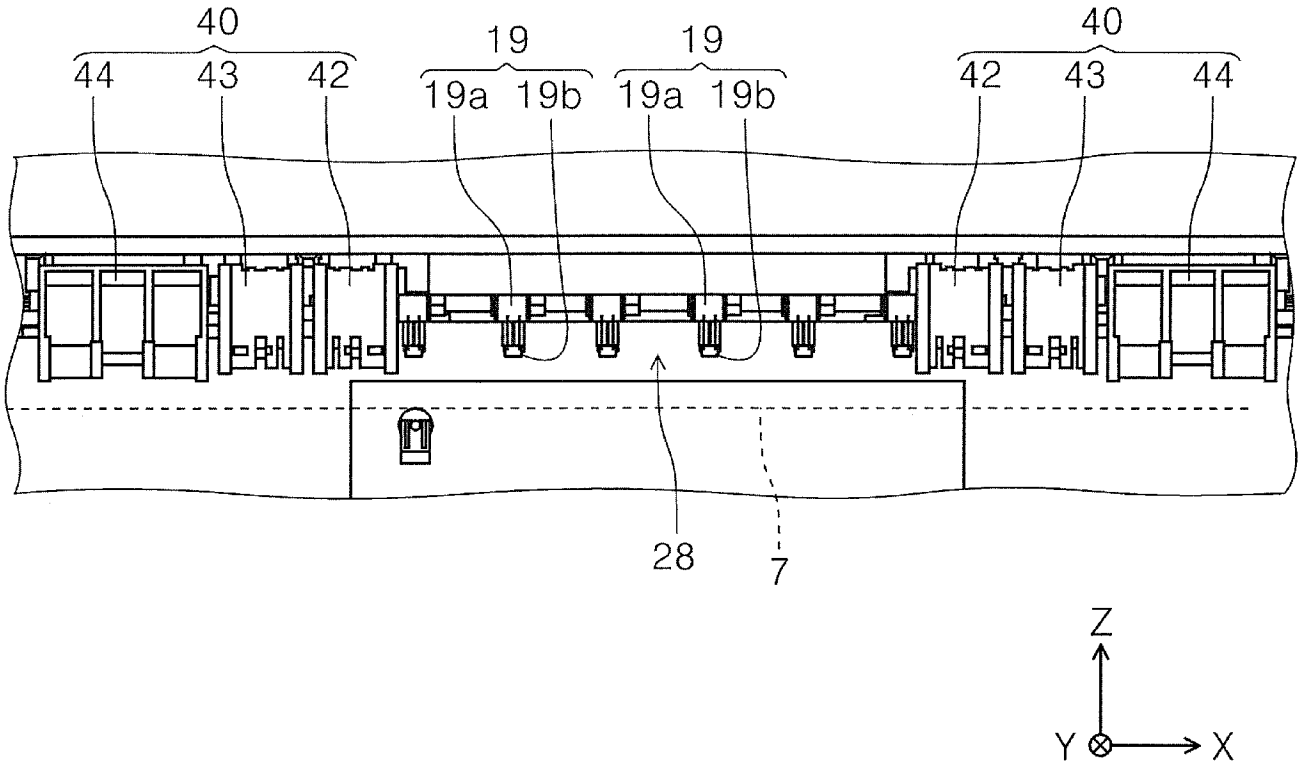
FIG. 25 is a view of FIG. 21 as viewed from the −Y direction side toward the +Y direction.
Figure 26:
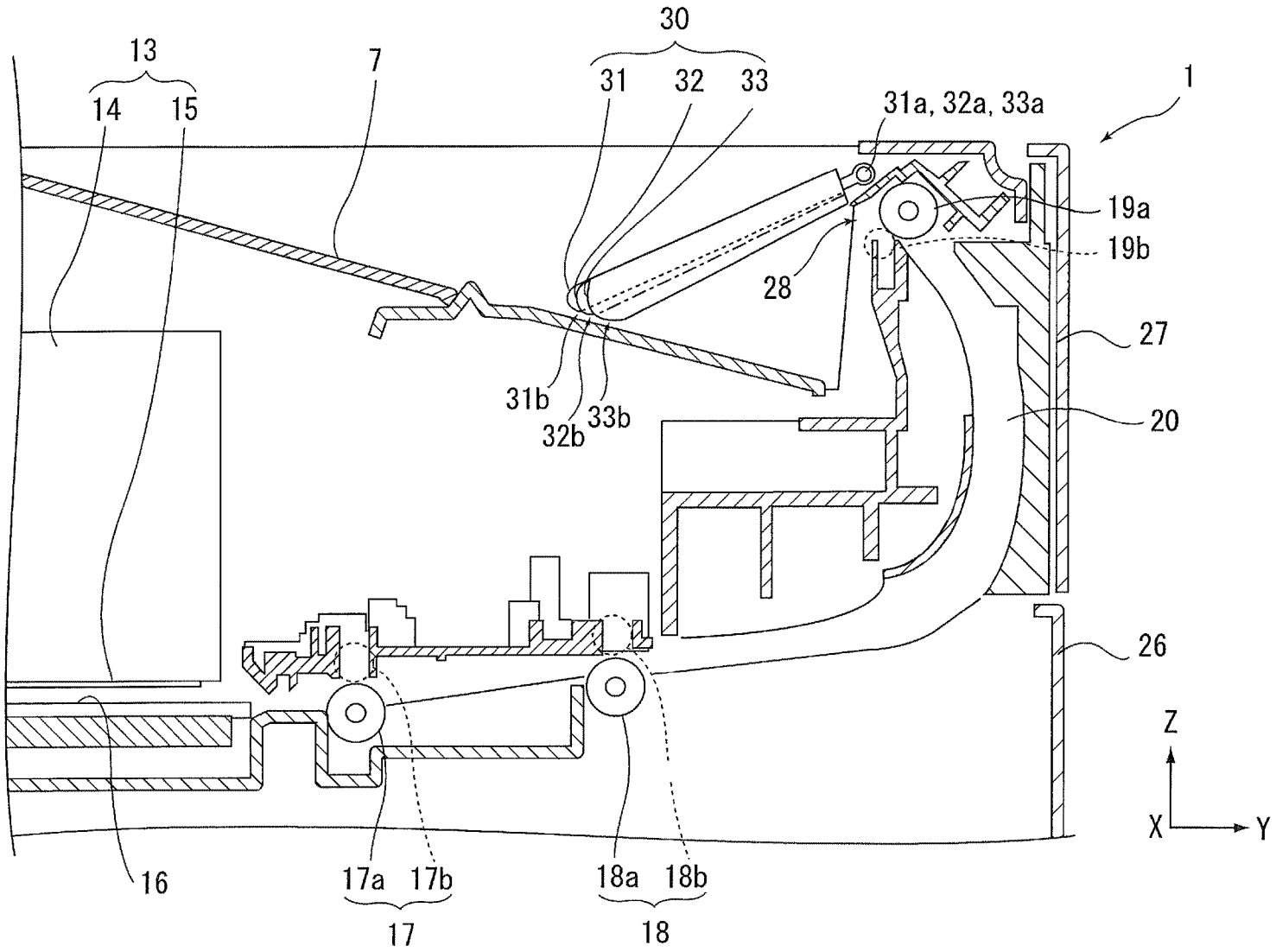
FIG. 26 is a schematic sectional diagram illustrating the main parts of a printer according to a modification example of the second embodiment.
Figure 27:
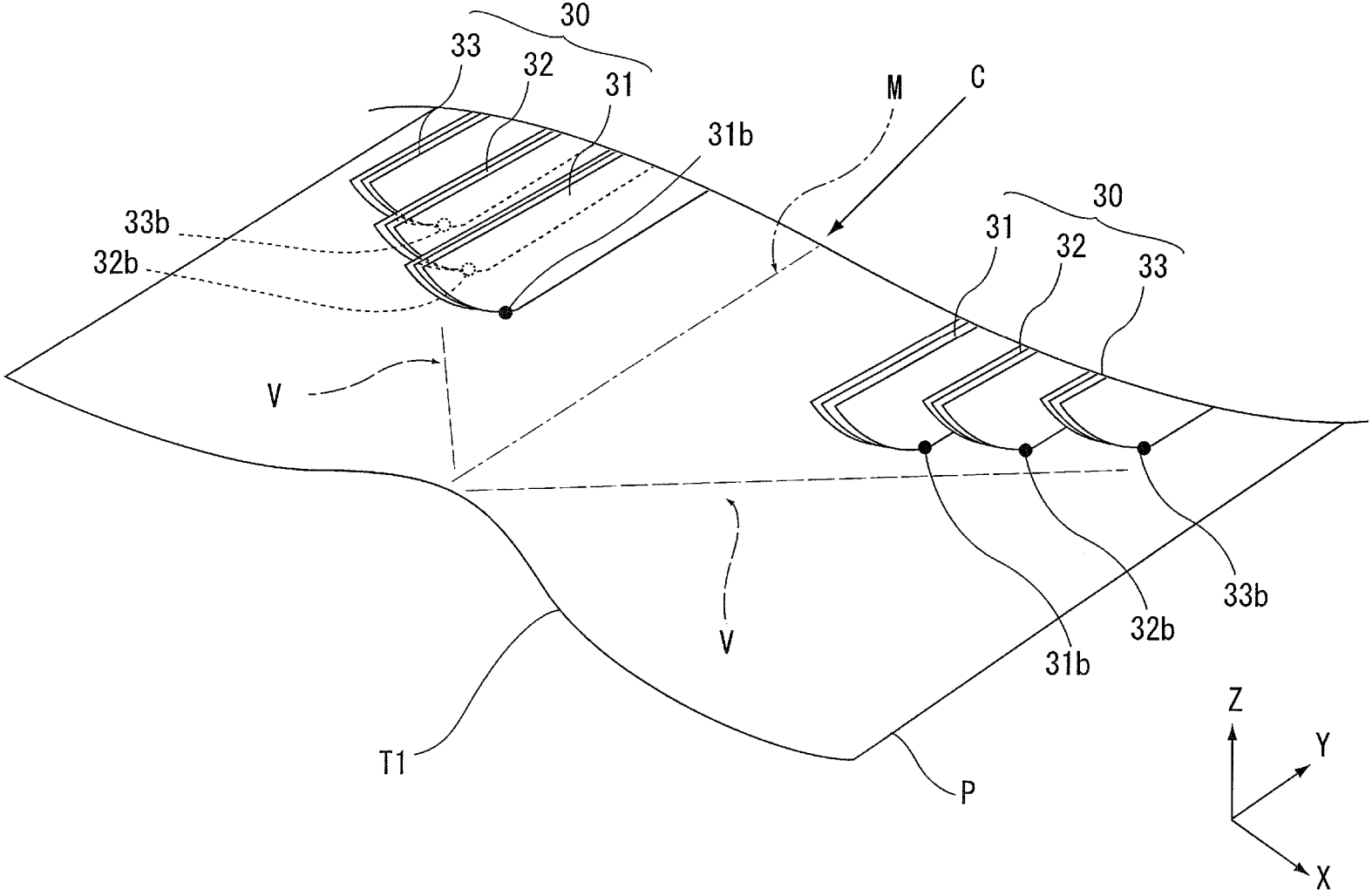
FIG. 27 is a view illustrating a state in which the retainer according to the modification example of the second embodiment retains the paper.

FIG. 20 is a perspective view illustrating a state in which the second retaining portion and a third retaining portion rock upward in the retainer. FIG. 21 is a perspective view illustrating a state in which the second, third, and fourth retaining portions rock upward in the retainer. FIG. 22 is a view of FIG. 18 as viewed from a −Y direction side toward a +Y direction. FIG. 23 is a view of FIG. 19 as viewed from the −Y direction side toward the +Y direction. FIG. 24 is a view of FIG. 20 as viewed from the −Y direction side toward the +Y direction. FIG. 25 is a view of FIG. 21 as viewed from the −Y direction side toward the +Y direction. FIG. 26 is a schematic sectional diagram illustrating the main parts of a printer according to a modification example of the second embodiment. FIG. 27 is a view illustrating a state in which the retainer according to the modification example of the second embodiment retains the paper.

In the present embodiment, the configurations which are the same as those in the first embodiment will be given the same reference numerals and the description thereof will be omitted.

Retainers 40 of the second embodiment illustrated in FIGS. 13 and 14 are provided with a first retaining portion 41 which is provided in a center region in the width direction, and second retaining portions 42 which are provided as a pair on both sides of the first retaining portion 41 in the width direction (the X-axis direction).

In the present embodiment, as illustrated in FIG. 14, the second retaining portions 42 are disposed to deviate from the first retaining portion 41 in the width direction which intersects the medium discharge direction, and as illustrated in FIG. 13, the second retaining portions 42 retain retaining positions 42*b* which are closer to the upstream (the +Y direction side) in the medium discharge direction than a retaining position 41*b* of the first retaining portion 41.

As illustrated in FIG. 14, the retainers 40 are provided with third retaining portions 43 which are provided as a pair on the outside of the second retaining portions 42 in the width direction, and fourth retaining portions 44 which are provided as a pair further to the outside of the third retaining portions 43 in the width direction.

As illustrated in FIG. 13, the third retaining portions 43 retain retaining positions 43*b* which are closer to the upstream than the retaining positions 42*b* of the second retaining portions 42 in the medium discharge direction, and the fourth retaining portions 44 retain retaining positions 44*b* which are closer to the upstream than the retaining positions 43*b* of the third retaining portions 43 in the medium discharge direction.

Due to the plurality of retaining portions which configures the retainers 40 including the first retaining portion 41 which retains the downstream in the medium discharge direction, the second retaining portions 42 which retain closer to the upstream in the medium discharge direction than the retaining position 41*b* of the first retaining portion 41, third retaining portions 43, and fourth retaining portions 44, as illustrated in FIG. 15, it is possible to retain the upstream (a leading end T1 side) of the paper P which is discharge from the discharge portion 28 using the first retaining portion 41, and it is possible to retain the downstream (the side close to the rear end, which is not illustrated, in FIG. 15) of the paper P using the second retaining portions 42, the third retaining portions 43, and the fourth retaining portions 44.

Therefore, as illustrated in FIG. 9, it is possible to retain the paper P which is curled in the medium discharge direction (for example, a case in which the paper P is discharge with a latitudinal grain) at retaining positions which are deviated from each other in the medium discharge direction (the Y-axis direction), and it is possible to maintain favorable stacking properties of the paper P on the first paper discharge tray 7.

Due to the second retaining portions 42 being provided as a pair on both sides in the width direction to interpose the first retaining portion 41, the third retaining portions 43 being provided as a pair on the outside of the pair of second retaining portions 42 in the width direction, and the fourth retaining portions 44 being provided as a pair further on the outside of the pair of third retaining portions 43 in the width direction, it is possible to also suppress the sides close to the side edges E1 and E2 of the paper P, and thus, in addition to retaining the curling in the medium discharge direction (for example, a case in which the paper P is discharge with a latitudinal grain) as in the paper P illustrated in FIG. 9, it is also possible to retain the curling in the width direction (for example, the medium which is discharge with a longitudinal grain) as illustrated in FIG. 10.

When closer to the upstream in the medium discharge direction (the −Y direction side) is retained by the retaining portions that are closer to the outside among the second retaining portions 42, the third retaining portions 43, and the fourth retaining portions 44, each of which being provided as a pair, as illustrated in FIG. 15, in the paper P which is discharge from the discharge portion 28, a mountain portion M (a dot and dash line) is formed in the vicinity of a center in the width direction (the position indicated by arrow C) and a valley portion V (a dash line) going along the retaining position 42*b*, the retaining position 43*b*, and the retaining position 44*b* is formed, and it is possible to bend the paper P such that the leading end T1 side is pressed against the first paper discharge tray 7 side.

Since the first retaining portion 41 retains the vicinity of the center in the width direction on the downstream in the medium discharge direction, even if the paper P is discharge in the medium discharge direction (the −Y direction), the shape which is bent into the leading end T1 of the paper P becomes easier to maintain.

For example, although the rear end of the paper P is nipped by the downstream side roller pair 19, in a state in which the discharging of the paper P from the discharge portion 28 is mostly complete, in the medium discharge direction, the second retaining portions 42, the third retaining portions 43, and the fourth retaining portions 44 come into contact with the paper P in the vicinity of the discharge portion 28 and the first retaining portion 41 comes into contact with the paper at a paper center portion (between the leading end T1 and the rear end T2 in FIG. 9). At this time, the second retaining portions 42, the third retaining portions 43, and the fourth retaining portions 44 have a role of rendering the paper posture at the side which is close to the discharge portion 28 a top surface convex shape (the shape of the mountain portion M in FIG. 15) and the first retaining portion 41 has a role of rendering the posture of the leading end of the paper a bottom surface convex shape (the shape which is closer to the downstream in the medium discharge direction than the valley portion V in FIG. 15) by pressing the paper against the stacking surface of the first paper discharge tray 7.

By forming, in the paper P, the top surface convex shape on the side which is close to the discharge portion 28 and the bottom surface convex shape on the leading end T1 of the paper P using the first retaining portions 41, the second retaining portions 42, the third retaining portions 43, and the fourth retaining portions 44, it is possible to improve the stacking properties of the paper P on the first paper discharge tray 7. It is also possible to improve the alignment of the paper P in the medium discharge direction using the first paper discharge tray 7.

It is possible to reduce a concern that the end portion of the paper P (the leading end T1 and the rear end T2 in a case of the paper P with a latitudinal grain illustrated in FIG. 9, and the side edges E1 and E2 in a case of the paper P with a longitudinal grain illustrated in FIG. 10) faces upward and the paper P which is previously discharge blocks the discharge portion 28.

Other Configurations of Retaining Portion

In the present embodiment, as illustrated in FIGS. 13 and 14, each of the first retaining portion 41, the second retaining portions 42, the third retaining portions 43, and the fourth retaining portions 44 is provided with a rotational movement shaft 41*a*, 42*a*, 43*a*, and 44*a* on the discharge portion 28 side, respectively, the retaining portions 41 to 44 are configured to rotate using the rotational movement shafts 41*a*, 42*a*, 43*a*, and 44*a* as axes and the free ends which proceed and withdraw with respect to the paper P (the end portions on the −Y direction side in FIG. 13) retain the paper.

In this configuration, the first retaining portion 41, the second retaining portions 42, the third retaining portions 43, and the fourth retaining portions 44 are capable of being pushed by the paper P which is discharge, for example, and escaping in the withdrawal direction which separates from the paper P. Therefore, it is possible to reduce the concern of the pressing force of each of the retaining portions from excessively being applied to the paper P.

The second retaining portions 42, the third retaining portions 43, and the fourth retaining portions 44, which are provided as pairs, are each provided at positions corresponding to both ends of the paper of corresponding different sizes in the width direction. In the present embodiment, as an example, the second retaining portions 42 which are positioned closest to the inside in the width direction are disposed at positions at which it is possible to retain both side edges in the width direction of an A6 size in which the longitudinal direction faces the medium discharge direction. The third retaining portions 43 which are positioned on the outside of the second retaining portions 42 are disposed at positions at which it is possible to retain both side edges in the width direction of an A5 size in which the longitudinal direction faces the medium discharge direction. The fourth retaining portions 44 which are positioned closest to the outside in the width direction are disposed at positions at which it is possible to retain both side edges in the width direction of the paper of an A4 size in which the longitudinal direction faces the medium discharge direction.

Therefore, it is possible to reliably retain the end portions in the width direction of the paper of various sizes and to more reliably suppress curling.

In the present embodiment, although the retainers 40 are provided with the first retaining portion 41, and, provided as pairs, the second retaining portions 42, the third retaining portions 43, and the fourth retaining portions 44, it is possible to adopt a configuration in which the fourth retaining portions 44 are omitted. It is also possible to adopt a configuration in which only the first retaining portion 41 and the pair of second retaining portions 42 are provided without providing the third retaining portions 43 and the fourth retaining portions 44.

It is possible to provide a pair of fifth retaining portions (not illustrated) further on the outside of the pair of fourth retaining portions 44 in the present embodiment. The fifth retaining portions retain closer to the upstream in the medium discharge direction (the +Y direction side) than the retaining positions 44*b* (FIG. 13) of the fourth retaining portions 44. In addition, it is possible to provide sixth retaining portions (not illustrated) further on the outside of the pair of fifth retaining portions. The sixth retaining portions retain closer to the upstream in the medium discharge direction than the retaining position of the fifth retaining portions.

In other words, the retainers 40 may be configured to include the third retaining portions 43 in addition to the first retaining portion 41 and the second retaining portions 42. Alternatively, it is possible to adopt a configuration further including third to nth retaining portions ($n \geq 4$).

In a case in which the retainers 40 are configured to further include third to nth retaining portions ($n \geq 4$), kth retaining portions ($n \geq k \geq 3$) are provided as a pair on both sides of the k-1-th retaining portions ($n \geq k \geq 3$) in the width direction and are configured to retain closer to the upstream in the medium discharge direction than the retaining position of the k-1-th retaining portion ($n \geq k \geq 3$).

For example, in a case in which the fifth and sixth retaining portions are provided, n=6. The fifth retaining portions (in a case in which k=5) are provided as a pair on both sides of the fourth (=k-1) retaining portions 44 in the width direction and are configured to retain closer to the upstream in the medium discharge direction than the retaining positions 44*b* (FIG. 13) of the fourth retaining portions 44. The sixth retaining portions (in a case in which k=6) are provided as a pair on both sides of the fifth (=k-1) retaining portions in the width direction and are configured to retain closer to the upstream in the medium discharge direction than the retaining position of the fifth retaining portion.

In other words, a configuration is adopted in which the closer the retaining portions are provided to the outside, the closer the retaining portions are to the upstream in the medium discharge direction (the −Y direction side) in comparison to the retaining portions which are provided on the inside. Accordingly, it is possible to handle a larger number of paper sizes.

The fifth retaining portions and the sixth retaining portions may be disposed at positions at which both side edges in the width direction of the paper of a different size from the second retaining portions 42 to the fourth retaining portions 44.

In other words, of the plurality of retaining portions which configures the retainers 40, the second and third retaining portions 42 and 43 or the second to nth retaining portions ($n \geq 4$) may be provided at positions corresponding to both ends in the width direction of the paper of corresponding different sizes.

The first retaining portion 41, the second retaining portions 42, the third retaining portions 43, and the fourth retaining portions 44 illustrated in FIG. 14 are configured such that the retaining force which retains the paper P toward the first paper discharge tray 7 is greater the closer the retaining portions are positioned to the outside in the width direction.

In the present embodiment, the retaining force which retains the paper P toward the first paper discharge tray 7 is ordered so as to be greatest at the fourth retaining portions 44, next at the third retaining portions 43, and next at the second retaining portions 42.

Ordinarily, curling increases more easily the larger the paper size and the retaining portions are more easily lifted by the repulsive force of the curling.

Of the plurality of retaining portions which is provided, due to the retaining force which retains the paper P toward the first paper discharge tray 7 being greater the closer the retaining portion is positioned to the outside in the width direction, it is possible to adopt a configuration in which paper having a large size in the width direction is firmly retained.

Next, a description will be given of a configuration for increasing the retaining force which retains the paper P toward the first paper discharge tray 7 more the closer the retaining portion is positioned to the outside in the width direction.

In the present embodiment, a predetermined retaining portion among the plurality of retaining portions overlaps the top side of the retaining portion which is first positioned on the outside in the width direction with respect to the predetermined retaining portion.

More specifically, as illustrated in FIG. 17, the third retaining portion 43 which is positioned on the inside of the fourth retaining portion 44 overlaps the fourth retaining portion 44 which is positioned closest to the outside in the width direction, and the second retaining portion 42 which is positioned on the inside of the third retaining portion 43 overlaps the third retaining portion 43. FIG. 17 illustrates the second retaining portion 42, the third retaining portion 43, and the fourth retaining portion 44 of the +X direction side in FIG. 16.

In FIG. 17, the second retaining portion 42 is provided with abutting portions 45*a* and 45*b* on both sides in the width direction, the third retaining portion 43 is provided with abutting portions 46*a* and 46*b* on both sides in the width direction, and the fourth retaining portion 44 is provided with abutting portions 47*a* and 47*b* on both sides in the width direction.

The abutting portion 46*b* on the +X direction side of the third retaining portion 43 which is positioned on the inside of the fourth retaining portion 44 in the width direction overlaps the abutting portion 47*a* on the −X direction side of the fourth retaining portion 44. The abutting portion 45*b* on the +X direction side of the second retaining portion 42 which is positioned on the inside of the third retaining portion 43 in the width direction overlaps the abutting portion 46*a* on the −X direction side of the third retaining portion 43.

In FIG. 16, the second retaining portion 42, the third retaining portion 43, and the fourth retaining portion 44 on the −X direction side are formed to be symmetrical to the second retaining portion 42, the third retaining portion 43, and the fourth retaining portion 44 on the +X direction side with respect to the center in the width direction.

In the present embodiment, the first retaining portion 41, the second retaining portions 42, the third retaining portions 43, and the fourth retaining portions 44 are configured to retain the paper using the weight of the first retaining portion 41, the second retaining portions 42, the third retaining portions 43, and the fourth retaining portions 44 themselves.

FIGS. 18 and 22 illustrate a state in which the free end sides of the second retaining portions 42, the third retaining portions 43, and the fourth retaining portions 44 face the first paper discharge tray 7 side due to the weight of the second retaining portions 42, the third retaining portions 43, and the fourth retaining portions 44 themselves. In FIGS. 18 to 25, the description of the first retaining portion 41 is omitted to facilitate understanding of the state of the second retaining portions 42, the third retaining portions 43, and the fourth retaining portions 44.

Of the second retaining portions 42 to the fourth retaining portions 44, the second retaining portions 42 which are closest to the inside in the width direction and overlap on the topmost level, from the state illustrated in FIGS. 18 and 22, may rock upward on their own as illustrated in FIGS. 19 and 23. The second retaining portions 42 retain the paper P toward the first paper discharge tray 7 using the retaining force of the weight of the second retaining portions 42 themselves.

Since the second retaining portions 42 overlap on the top side of the third retaining portions 43, as illustrated in FIGS. 20 and 24, the third retaining portions 43 rock upward integrally with the second retaining portions 42. In the third retaining portions 43, the weight of the second retaining portions 42 which overlap the third retaining portions 43 is added to the weight of the third retaining portions 43 themselves and becomes a greater retaining force than the retaining force of the second retaining portions 42.

Since the third retaining portions 43 on the top side overlap the fourth retaining portions 44, as illustrated in FIGS. 21 and 25, the fourth retaining portions 44 rock upward integrally with the third retaining portions 43 which rock integrally with the second retaining portions 42. In the fourth retaining portions 44, the weight of the second retaining portions 42 and the third retaining portions 43 which overlap the fourth retaining portions 44 is added to the weight of the fourth retaining portions 44 themselves and becomes a greater retaining force than the retaining force of the third retaining portions 43.

In this manner, due to a retaining portion which is adjacent to the inside of a retaining portion which is positioned on the outside in the width direction overlapping the retaining portion which is positioned on the outside in the width direction, it is possible to increase the retaining force which retains the paper P toward the first paper discharge tray 7 more the closer the retaining portion is positioned to the outside.

It is possible to configure a predetermined retaining portion (for example, the second retaining portions 42) to rock following the rocking of the retaining portion (for example, the third retaining portions 43) which is positioned first on the outside in the width direction with respect to the predetermined retaining portion.

For example, when the fourth retaining portions 44 come into contact with the paper P and are lifted up, the second retaining portions 42 and the third retaining portions 43 are also lifted up together.

Here, since the first paper discharge tray 7 is inclined as illustrated in FIG. 13 when the retaining positions 42*b* of the second retaining portions 42, the retaining positions 43*b* of the third retaining portions 43, and the retaining positions 44*b* of the fourth retaining portions 44 are in contact with the first paper discharge tray 7, the retaining positions 42*b* and the retaining positions 43*b* are positioned higher than the retaining position 44*b*.

When the fourth retaining portions 44 are lifted up and the second retaining portions 42 and the third retaining portions 43 are also lifted up together, the relative positional relationship between the retaining positions 42*b*, the retaining positions 43*b*, and the retaining positions 44*b* is maintained unchanged. Therefore, when the fourth retaining portions 44 are lifted up, the second retaining portions 42 and the third retaining portions 43 do not come into contact with the paper P.

Similarly, when the retaining positions 43*b* of the third retaining portions 43 come into contact with the paper P and are lifted up, the second retaining portions 42 are also lifted up and the retaining positions 42*b* of the second retaining portions 42 do not contact the paper P.

In other words, only the corresponding retaining portions come into contact with each size of paper. For example, when the paper of an A4 size is discharge, only the fourth retaining portions 44 corresponding to the paper of the A4 size and the first retaining portion 41 of the center come into contact with the paper.

In this configuration, it is possible to suppress an increase in the contact load of the retaining portions while increasing the load of the retaining portions which are positioned on the outside in the width direction.

In the present embodiment, the first retaining portion 41 which retains the center in the width direction is not engaged with the other retaining portions. Therefore, the first retaining portion 41 is capable of rocking on its own in the same manner as the second retaining portions 42.

In the present embodiment, it is possible to configure the first retaining portion 41, the second retaining portions 42, the third retaining portions 43, and the fourth retaining portions 44 to press toward the first paper discharge tray 7 using a pressing member such as a spring.

It is also possible to render the second retaining portions 42 to the fourth retaining portions 44 such that the retaining force is increased more the closer to the outside in the width direction by pressing the second retaining portions 42, the third retaining portions 43, and the fourth retaining portions 44 with corresponding pressing members having different pressing forces without overlapping the retaining portions which are on the inside in the width direction with the retaining portions which are next thereto on the outside.

It is possible to configure the first retaining portion 41 to the fourth retaining portions 44 to include a discharging function. For example, it is possible to configure the first retaining portion 41 to the fourth retaining portions 44 to be formed by a material having conductivity and to be grounded (earthed) via the respective rotational movement shafts 41*a*, 42*a*, 43*a*, and 44*a* (which are formed by a metal or the like having conductivity).

It is possible to adopt a configuration in which the discharging function is not given to all of the retaining portions and a portion of the retaining portions (for example, the first retaining portion 41 which is provided at the center in the width direction) is given the discharging function.

Since it is not necessary to provide a discharging portion separate from the retaining portion due to the retaining portion having a discharging function, it is sufficient to have a lower number of parts and it is possible to realize a reduction in the number of processes and a cost reduction.

Modification Example of Second Embodiment

Modification Example 2

A description will be given of the modification example of the second embodiment with reference to FIGS. 26 and 27. FIG. 26 is a schematic sectional diagram illustrating the main parts of a printer according to a modification example of the second embodiment. FIG. 27 is a view illustrating a state in which the retainer according to the modification example of the second embodiment retains the paper.

As illustrated in FIGS. 26 and 27, for the plurality of retaining portions, a retainer 30 which serves as the modification example of the second embodiment is provided with first retaining portions 31, second retaining portions 32, and third retaining portions 33. The second retaining portions 32 retain closer to the upstream in the medium discharge direction (the −Y direction side) than the retaining positions of the first retaining portions 31, and the third retaining portions 33 retain closer to the upstream in the medium discharge direction than the retaining positions of the second retaining portions 32.

In FIGS. 26 and 27, a reference numeral 31*b* is the retaining positions of the first retaining portions 31, a reference numeral 32*b* is the retaining positions of the second retaining portions 32, and a reference numeral 33*b* is the retaining positions of the third retaining portions 33.

More specifically, as illustrated in FIG. 27, the second retaining portions 32 are disposed to deviate in the width direction (the X-axis direction) which intersects the medium discharge direction (the Y-axis direction) with respect to the first retaining portions 31, the first retaining portions 31 are provided as a pair on both sides interposing a center region in the width direction, and the second retaining portions 32 are provided as a pair on the outside of the pair of first retaining portions 31 in the width direction.

The third retaining portions 33 are provided as a pair on the outside of the pair of second retaining portions 32 in the width direction.

In other words, the plurality of retaining portions which configures the retainers 30 is provided as pairs in the order of the first retaining portions 31, the second retaining portions 32, and the third retaining portions 33 from the inside in the width direction, and is configured to retain closer to the upstream in the medium discharge direction (the −Y direction side) the closer the retaining portion is to the outside.

In other words, the retainers 30 are configured not to include the first retaining portion 41 of the retainers 40 which are described earlier. The first retaining portions 31, the second retaining portions 32, and the third retaining portions 33 of the retainers 30 correspond to the second retaining portions 42, the third retaining portions 43, and the fourth retaining portions 44 of the retainers 40.

Even in a case in which the retaining portions which retain closer to the downstream than the first retaining portions 31 are not present at the center in the width direction, when the retaining portions which are provided as pairs (the first retaining portions 31, the second retaining portions 32, and the third retaining portions 33) are configured to retain closer to the upstream in the medium discharge direction the closer the retaining portions are to the outside (the −Y direction side), it is possible to bend the paper P as illustrated in FIG. 27. In other words, the mountain portion M (the dot and dash line) is formed in the vicinity of the center (the position illustrated by the arrow C) in the width direction of the paper P which is discharge from the discharge portion 28, the valley portions V (the dash lines) which go along the retaining positions 31*b*, the retaining positions 32*b*, and the retaining positions 33*b* are formed, and it is possible to bend the paper P such that the leading end T1 side in the width direction is pressed against the first paper discharge tray 7 side.

When the paper P is bent in this manner, the end portion of the paper P (the leading end T1 and the rear end T2 in a case of the paper P with a latitudinal grain illustrated in FIG.

9, and the side edges E1 and E2 in a case of the paper P with a longitudinal grain illustrated in FIG. 10) is suppressed from facing upward.

Accordingly, it is possible to reduce a concern of the paper P which is discharge previously blocking the discharge portion 28. It is possible to improve the stacking properties on the first paper discharge tray 7.

Third Embodiment

In the third embodiment, a description will be given of still another embodiment of the retainer based on FIGS. 28 to 35. Even in the third embodiment, the configurations which are the same as those in the first embodiment and the second embodiment are given the same reference numerals and the description thereof will be omitted.

Figure 28:
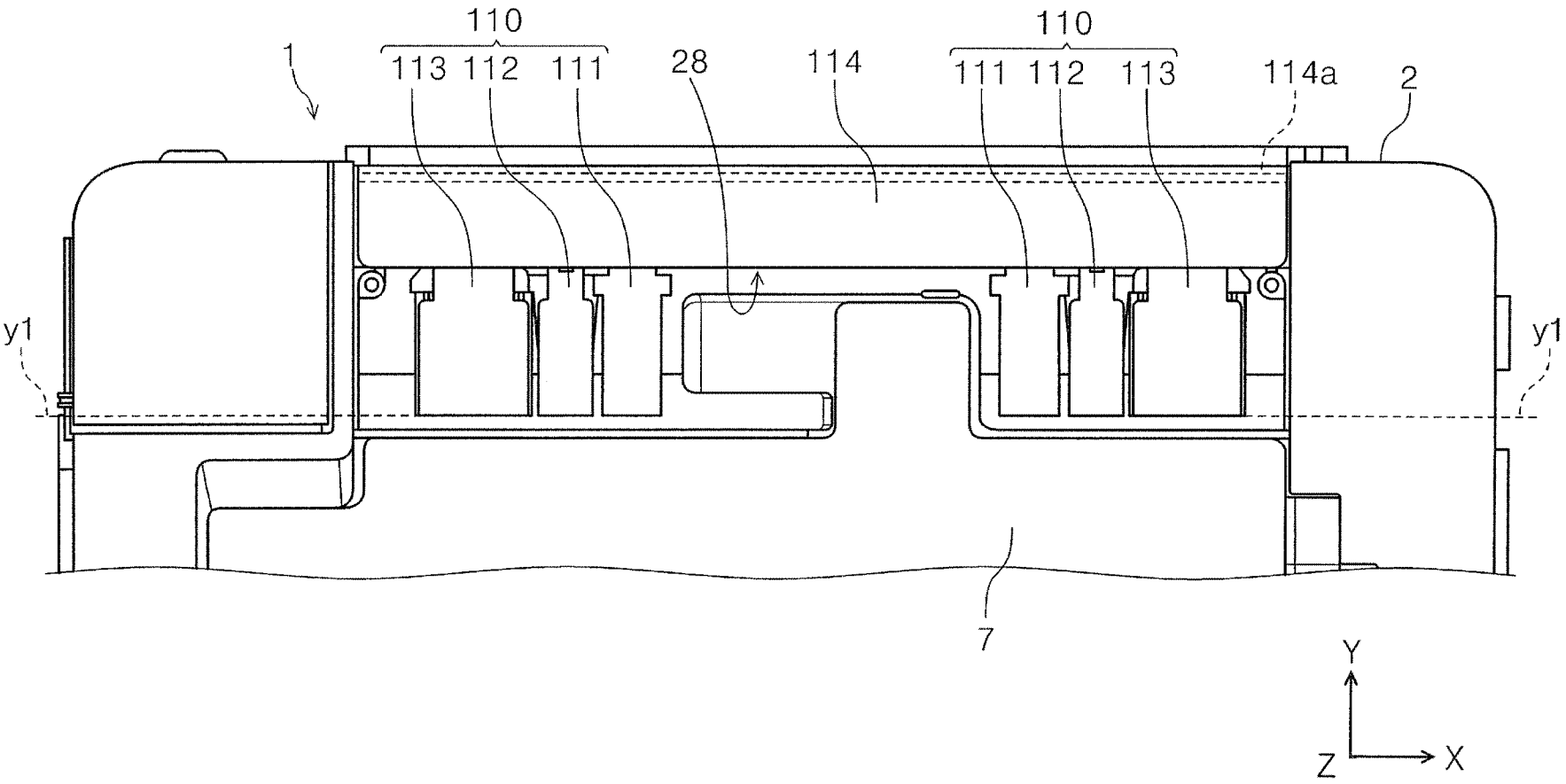
FIG. 28 is a plan view of the main parts of a printer according to a third embodiment.

As illustrated in FIG. 28, for the plurality of retaining portions, a retainer 110 according to the present embodiment is provided with first retaining portions 111, second retaining portions 112, and third retaining portions 113, each provided as a pair. The second retaining portions 112 retain closer to the upstream in the medium discharge direction (the −Y direction side) than the retaining positions of the first retaining portions 111, and the third retaining portions 113 retain closer to the upstream in the medium discharge direction than the retaining positions of the second retaining portions 112.

Even in the present embodiment, the retaining portions on the inside in the width direction overlap the retaining portions which are positioned next on the outside. In other words, a portion of the second retaining portions 112 overlaps a portion of the third retaining portions 113 and a portion of the first retaining portions 111 overlaps a portion of the second retaining portions 112.

It is possible to cause the first retaining portions 111 to rotationally move independently, and when the second retaining portions 112 are caused to rotationally move, the first retaining portions 111 also follow the second retaining portions 112 and rotationally move. When the third retaining portions 113 are caused to rotationally move, the first retaining portions 111 and the second retaining portions 112 also follow the third retaining portions 113 and rotationally move.

In other words, a configuration is adopted in which the closer the retaining portions are to the outside, the greater the force retaining the paper.

Figure 29:
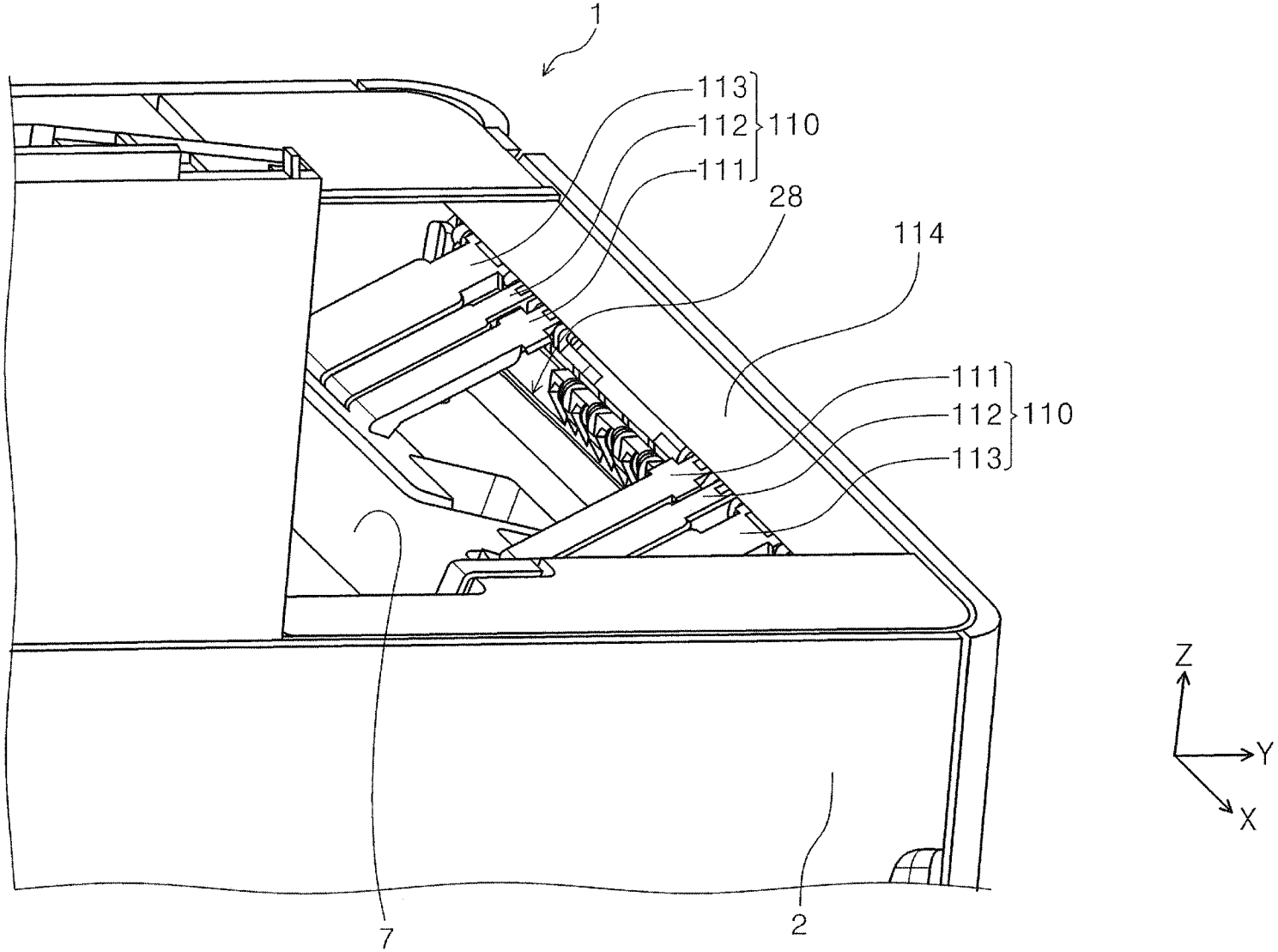
FIG. 29 is a perspective view illustrating a state in which a plurality of retaining portions according to the third embodiment assumes a retaining posture.
Figure 30:
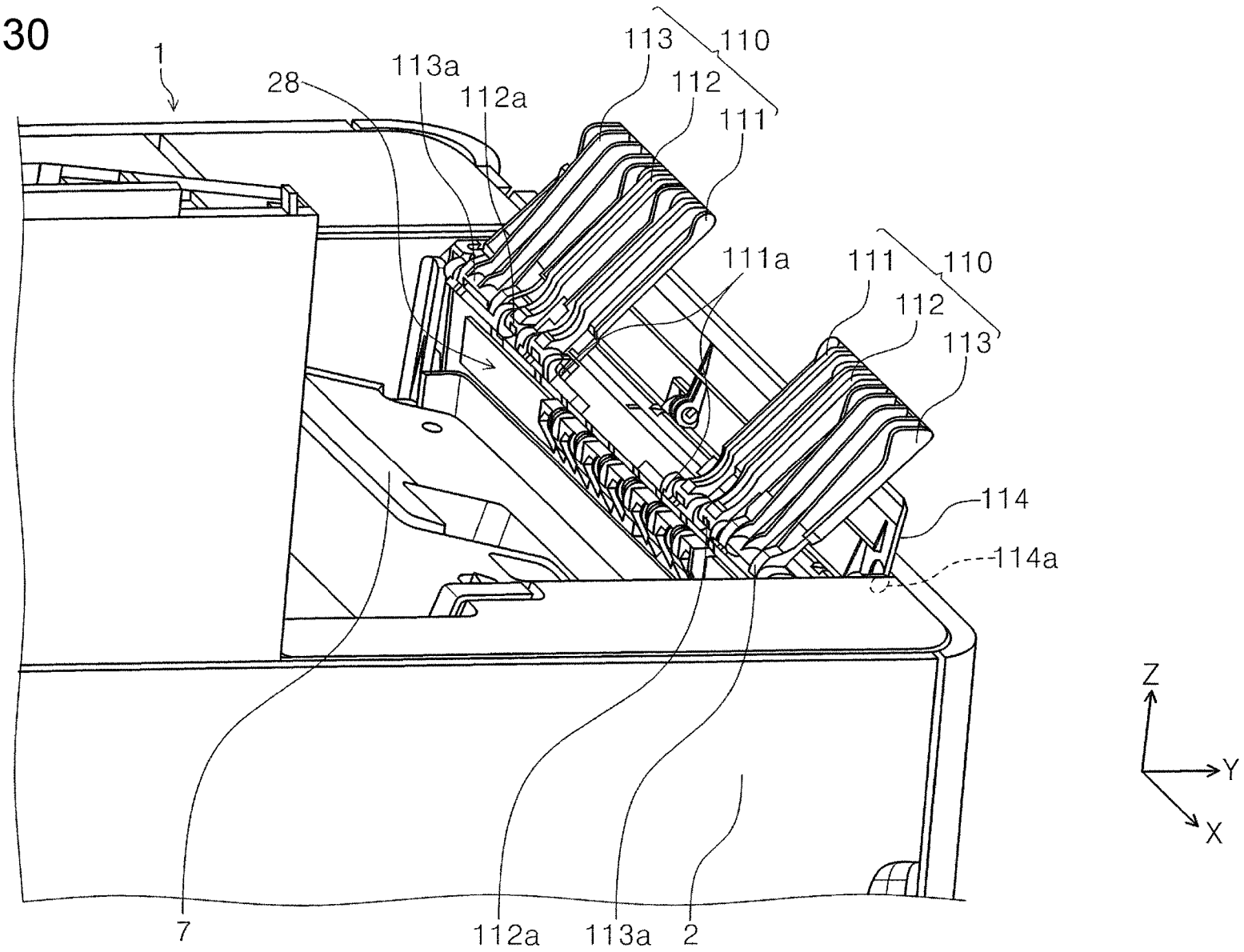
FIG. 30 is a perspective view illustrating a state in which the plurality of retaining portions according to the third embodiment rotationally moves in a direction separating from a first paper discharge tray.
Figure 33:
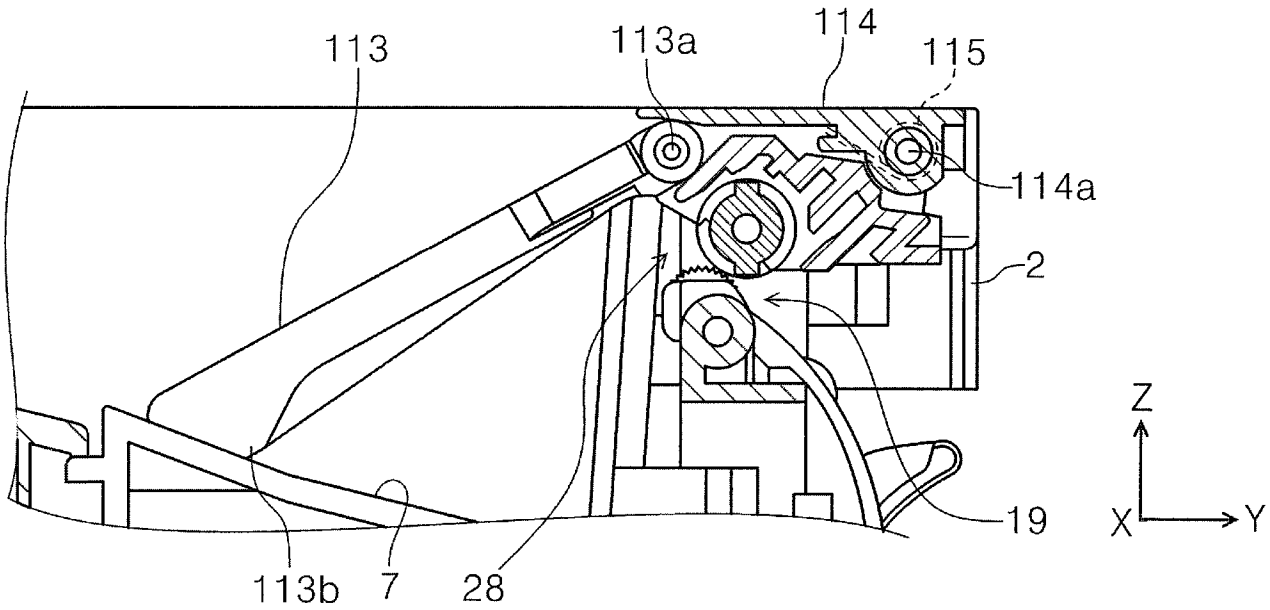
FIG. 33 is a lateral sectional diagram illustrating a state in which the retaining portions assume a retaining posture.
Figure 35:
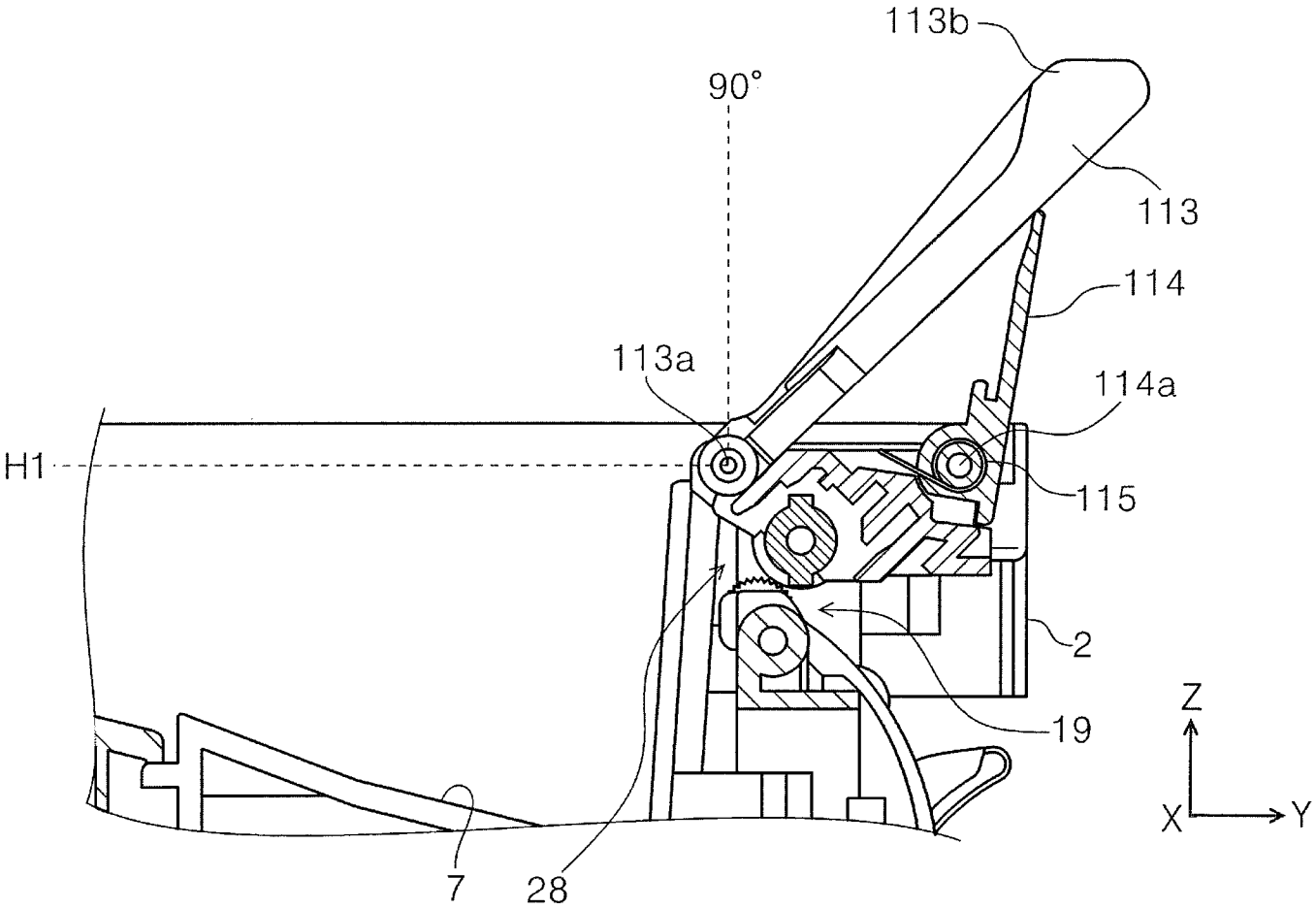
FIG. 35 is a lateral sectional diagram illustrating a state in which the retaining portions rotationally move in a direction separating from the first paper discharge tray until a paper discharge portion cover assumes an open state.

As illustrated in FIGS. 29 and 33, in a case in which the first retaining portions 111, the second retaining portions 112, and the third retaining portions 113 rotationally move from a retaining posture which retains the paper toward the first paper discharge tray 7 in a direction separating from the paper on the first paper discharge tray 7 as illustrated in FIG. 30, the first retaining portions 111, the second retaining portions 112, and the third retaining portions 113 as illustrated in FIG. 35 are configured to be capable of rotational movement by an angle greater than or equal to 90° from a horizontal plane (for example, the X-Y plane at the dot line position indicated by the reference numeral H1).

When the paper is removed from the first paper discharge tray 7 after the recording, when the first retaining portions 111, the second retaining portions 112, and the third retaining portions 113 remain in the retaining posture which retains the paper, the retaining portions may become a hindrance, come into contact with the paper, causing damage such as scratches and folds, and the like.

In the present embodiment, since the first retaining portions 111, the second retaining portions 112, and the third retaining portions 113 rotationally move from the horizontal plane (the X-Y plane) by an angle greater than or equal to 90° and separate from the first paper discharge tray 7, it is possible to reduce the likelihood that the retaining portions impede the removal of the paper from the first paper discharge tray 7, come into contact with the paper, and the like.

Respective rotational movement shafts 111*a*, 112*a*, and 113*a* of the first retaining portions 111, the second retaining portions 112, and the third retaining portions 113 are provided in the inner portion of the housing 2 in which the discharge portion 28 is provided.

More specifically, the rotational movement shafts 111*a*, 112*a*, and 113*a* are disposed below an discharge portion cover 114 which is provided in the housing 2 in which the discharge portion 28 is provided, the discharge portion cover 114 opening and closing a portion of the housing 2, and the rotational movement shafts 111*a*, 112*a*, and 113*a* are configured not be exposed from outside.

Figure 31:
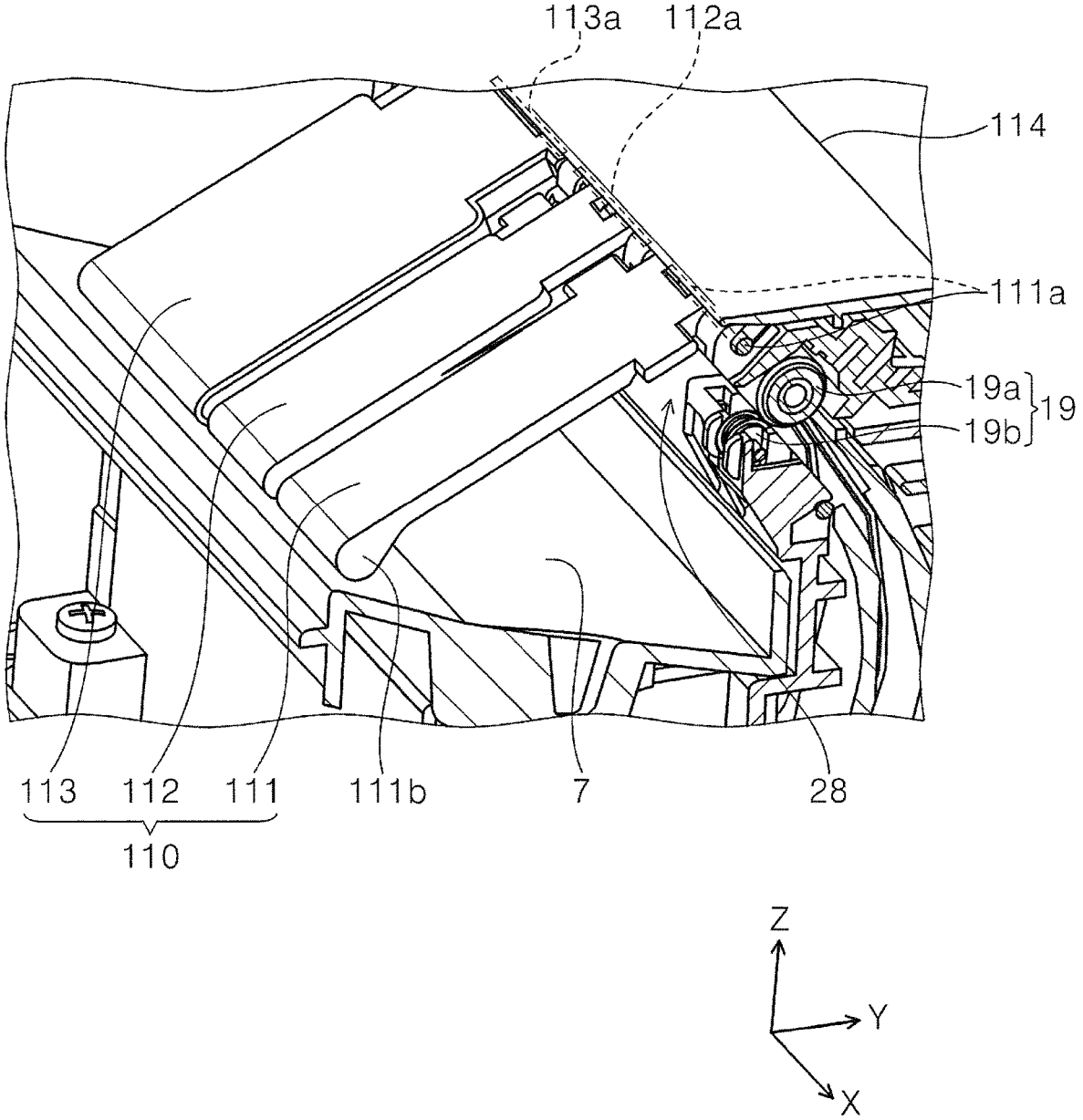
FIG. 31 is a sectional perspective view of the periphery of the retainer according to the third embodiment.

As illustrated in FIG. 31, the discharge portion cover 114 is "a cover portion" which covers the tops of the respective rotational movement shafts 111*a*, 112*a*, and 113*a* of the first retaining portions 111, the second retaining portions 112, and the third retaining portions 113 in the retaining posture which retains the paper toward the first paper discharge tray 7 in the closed state.

When the rotational movement shafts 111*a*, 112*a*, and 113*a* which are the connecting portions between the first retaining portions 111, the second retaining portions 112, the third retaining portions 113 and the inner portion (the apparatus main body) of the housing 2 are exposed to the outside, the rotational movement shafts 111*a*, 112*a*, and 113*a* may be easily accessed, leading to destruction, and the smooth rotational movement of the first retaining portions 111, the second retaining portions 112, the third retaining portions 113 may be hindered by the adherence of dust and the like to the rotational movement shafts 111*a*, 112*a*, and 113*a*.

Due to the rotational movement shafts 111*a*, 112*a*, and 113*a* being covered by the discharge portion cover 114 and being provided in the inner portion of the housing 2, it is possible to suppress such problems.

Figure 34:
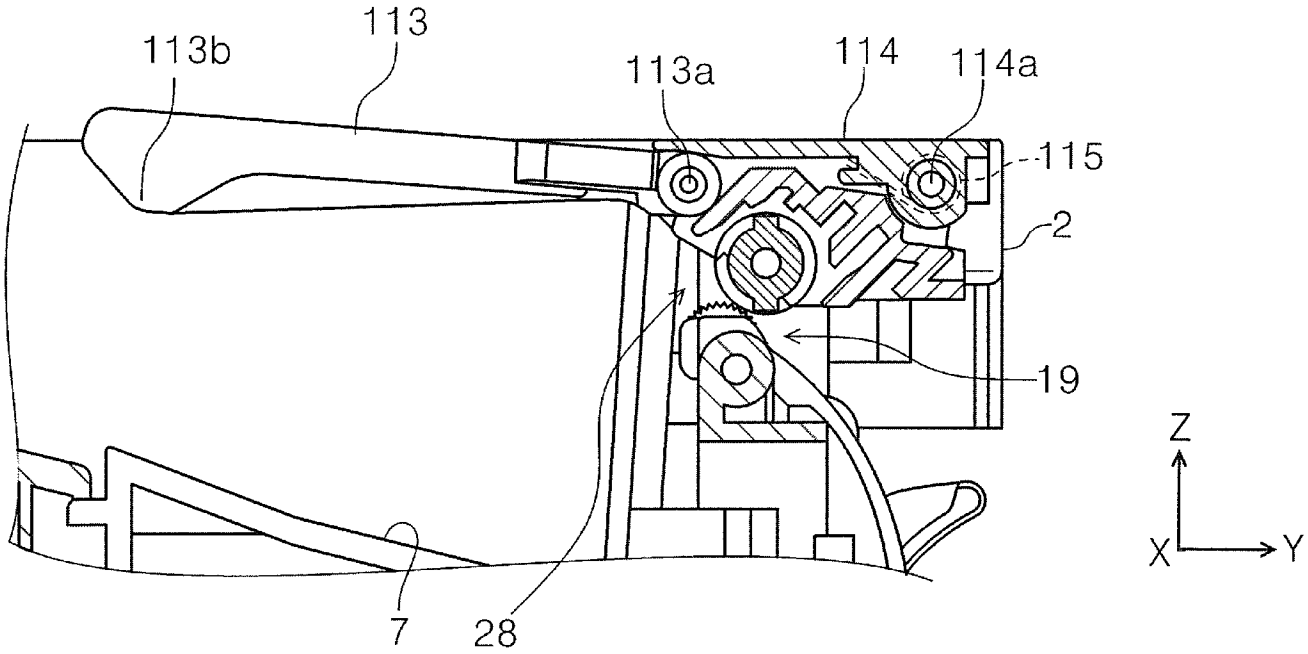
FIG. 34 is a lateral sectional diagram illustrating a state in which the retaining portions rotationally move in a direction separating from the first paper discharge tray from a state in which the retaining portions assume the retaining posture.

Here, as long as it is sufficient to suppress only the access to the rotational movement shafts 111*a*, 112*a*, and 113*a* and the adherence of dust and the like, the space above the rotational movement shafts 111*a*, 112*a*, and 113*a* may be simply covered by the housing 2 instead of by the discharge portion cover 114 which opens and closes. However, as illustrated in FIG. 34, when the space above the rotational movement shafts 113*a* is covered, since the third retaining portions 113 come into contact with the member (the discharge portion cover 114 in the closed state in FIG. 34) which covers the space above the third retaining portions 113, the third retaining portions 113 may not rotationally move any further. Although FIG. 34 describes the third retaining portions 113 as an example, the same applies to the first retaining portions 111 and the second retaining portions 112.

Therefore, the discharge portion cover 114 of the present embodiment is configured to be capable of being pushed upward by the first retaining portions 111, the second retaining portions 112, and the third retaining portions 113 which rotationally move in a direction separating from the first paper discharge tray 7 and rotationally moving from the closed state illustrated in FIGS. 29 and 33 to the open state illustrated in FIGS. 30 and 35. In other words, in a case in which the first retaining portions 111, the second retaining portions 112, and the third retaining portions 113 are rotationally moved to the position of FIG. 35, the discharge portion cover 114 also follows and assumes the open state illustrated in FIG. 35.

In this manner, due to the discharge portion cover 114 being capable of rotational movement, it is possible to suppress the access to each of the rotational movement shafts and the adherence of dust and the like using the discharge portion cover 114 and further to suppress hindering the rotational movement of each of the retaining portions in a direction separating from the first paper discharge tray 7.

A pressing member 115 which presses the discharge portion cover 114 in a closing direction is provided on a rotational movement shaft 114*a* of the discharge portion cover 114 illustrated in FIGS. 33 to 35. In the present embodiment, a torsion spring is used as an example of the pressing member 115.

For example, when the user removes the paper from the first paper discharge tray 7 after the recording, in a case in which the user causes the third retaining portions 113 to rotationally move from the retaining posture of the paper (the state of FIG. 33) further in a direction separating from the first paper discharge tray 7 than the position of FIG. 34, that is, the position at which the third retaining portions 113 come into contact with the distal end of the discharge portion cover 114, the third retaining portions 113 push up the discharge portion cover 114 to the open state of FIG. 35 while rotationally moving against the pressing force of the pressing member 115.

Meanwhile, in a case in which the third retaining portions 113 are returned to the retaining posture illustrated in FIG. 33 if the hand of the user is released, the discharge portion cover 114 is automatically closed by the pressing force of the pressing member 115, and thus, the third retaining portions 113 automatically rotationally move in a direction returning to the retaining posture. Therefore, it is possible to automatically return each of the retaining portions to the retaining posture.

Figure 32:
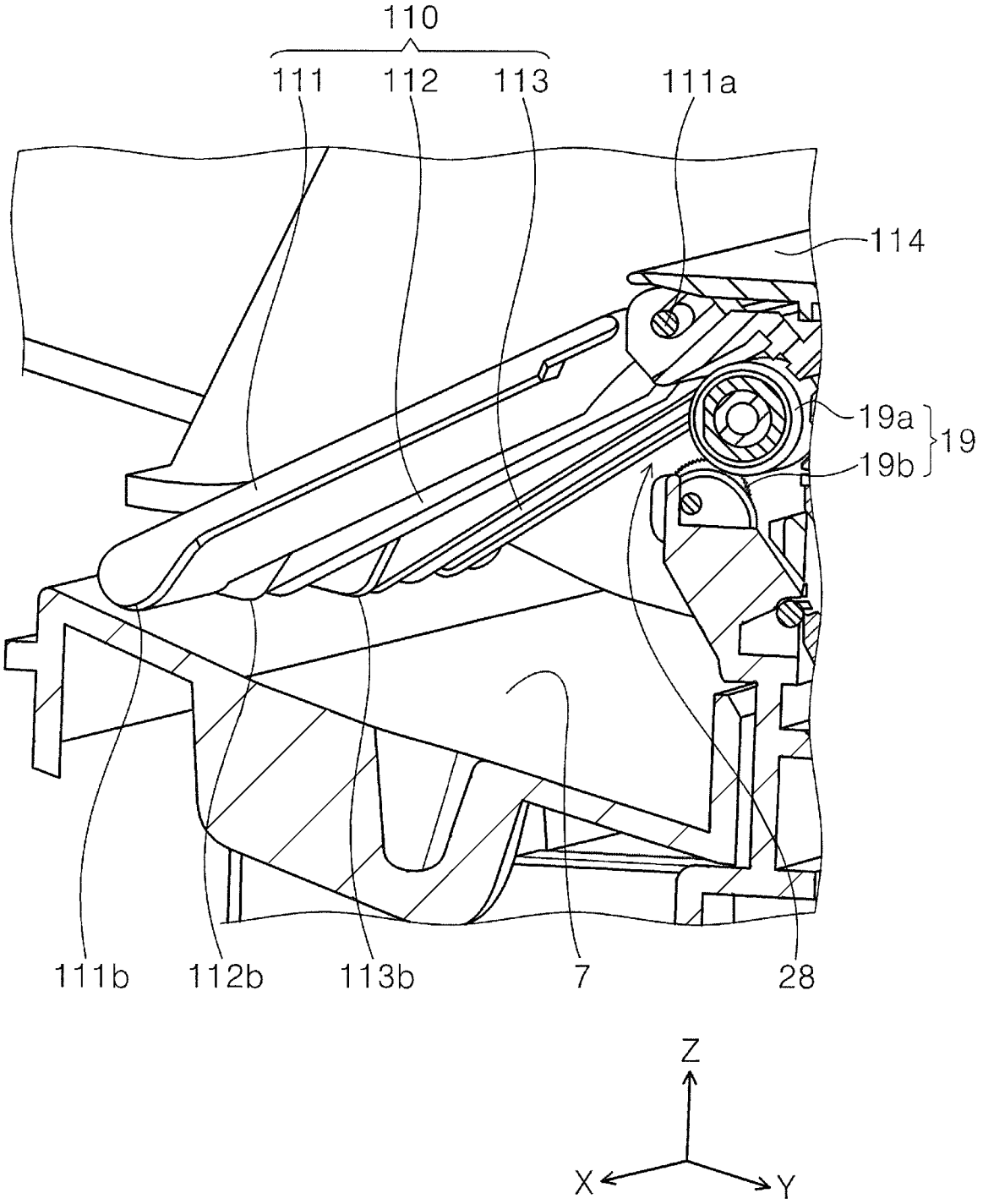
FIG. 32 is a sectional perspective view of the periphery of the retainer as viewed from a different direction from that of FIG. 31.

In the present embodiment, as illustrated in FIG. 28, the first retaining portions 111, the second retaining portions 112, and the third retaining portions 113 form a shape in which the distal end positions in the Y-axis direction line up at a position y1, and as illustrated in FIG. 32, respective retaining positions 101*b*, 102*b*, and 103*b* are formed in a shape which retains closer to the upstream in the medium discharge direction the closer the retaining portions are to the outside in the width direction (the X-axis direction).

Since the distal end positions of the first retaining portions 111, the second retaining portions 112, and the third retaining portions 113 are lined up in a case in which the first paper discharge tray 7 is viewed in plan view, it is possible to achieve a favorable external appearance.

Modification Example of Third Embodiment

A description will be given of a modification example of the configuration in which each of the retaining portions of the retainer 110 is attached to the inner portion of the housing 2 so as to rotationally move by an angle greater than or equal to 90° from a horizontal plane based on FIGS. 36 to 39.

The connecting portions of the first retaining portions 111, the second retaining portions 112, and the third retaining portions 113 to the apparatus main body described in the third embodiment are may be formed in a similar manner to the retaining portion 120 which is described in FIGS. 36 to 39.

Figure 36:
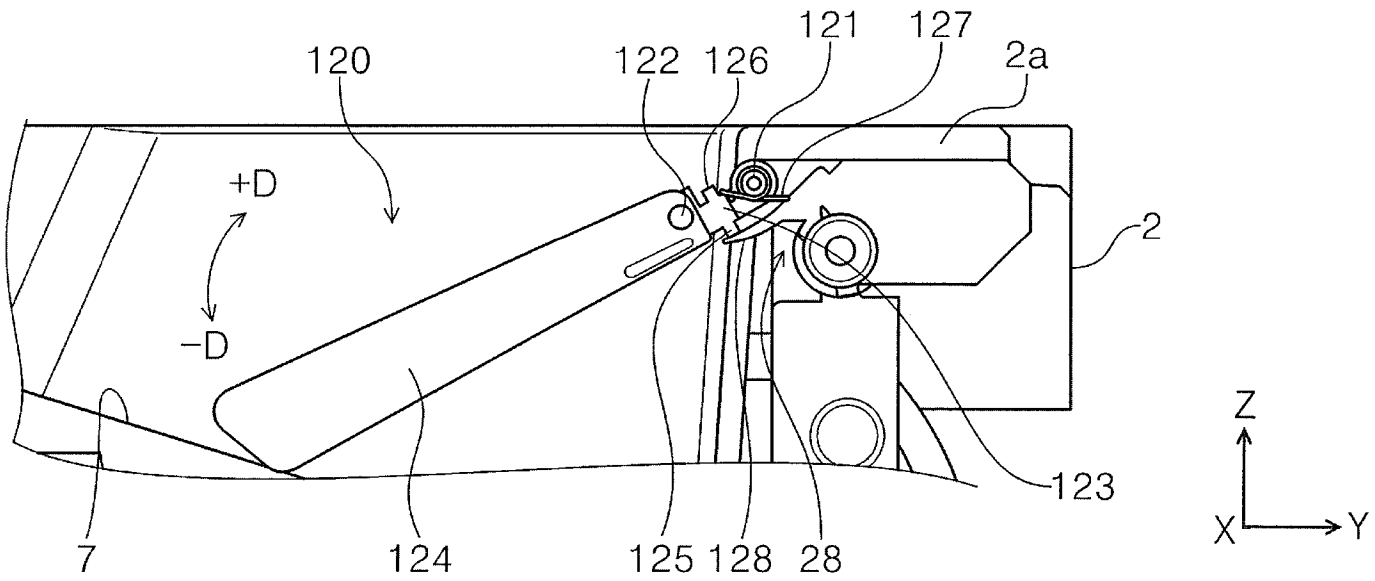
FIG. 36 is a lateral sectional diagram explaining a modification example of the retaining portion according to the third embodiment.

The retaining portion 120 illustrated in FIG. 36 is provided with two rotational movement shafts, that is, a first rotational movement shaft 121 and a second rotational movement shaft 122 as the rotational movement shafts which are provided on the discharge portion 28 side.

The retaining portion 120 is provided with a base member 123 and a distal end member 124. The base member 123 rocks in a direction proceeding or withdrawing with respect to the first paper discharge tray 7 using the first rotational movement shaft 121 which is provided on the housing 2 side as an axis, and the distal end member 124 rocks in a direction proceeding or withdrawing with respect to the first paper discharge tray 7 using the second rotational movement shaft 122 which is provided on the free end side of the base member 123 as an axis, the distal end member 124 retaining the paper toward the first paper discharge tray 7.

The first rotational movement shaft 121 is at a position at which the space above the first rotational movement shaft 121 is covered by a first top surface portion 2*a* which is a portion of the housing 2, and the second rotational movement shaft 122 is at a position at which the space above the second rotational movement shaft 122 is not covered by the housing 2.

The base member 123 is provided with a first contact portion 125 and a second contact portion 126. A torsion spring which serves as a pressing member 127 is provided on the first rotational movement shaft 121 of the base member 123, and the free end side of the base member 123 is pressed in a direction (a −D direction illustrated by an arrow in FIG. 36) which progresses to the first paper discharge tray 7 side. The rotation of the free end side of the base member 123 in a direction which progresses to the first paper discharge tray 7 side is restricted by the first contact portion 125 coming into contact with a contacted portion 128 which is provided in the inner portion of the housing 2.

The distal end member 124 is configured to progress to the first paper discharge tray 7 side due to the weight of the distal end member 124 itself.

Figure 37:
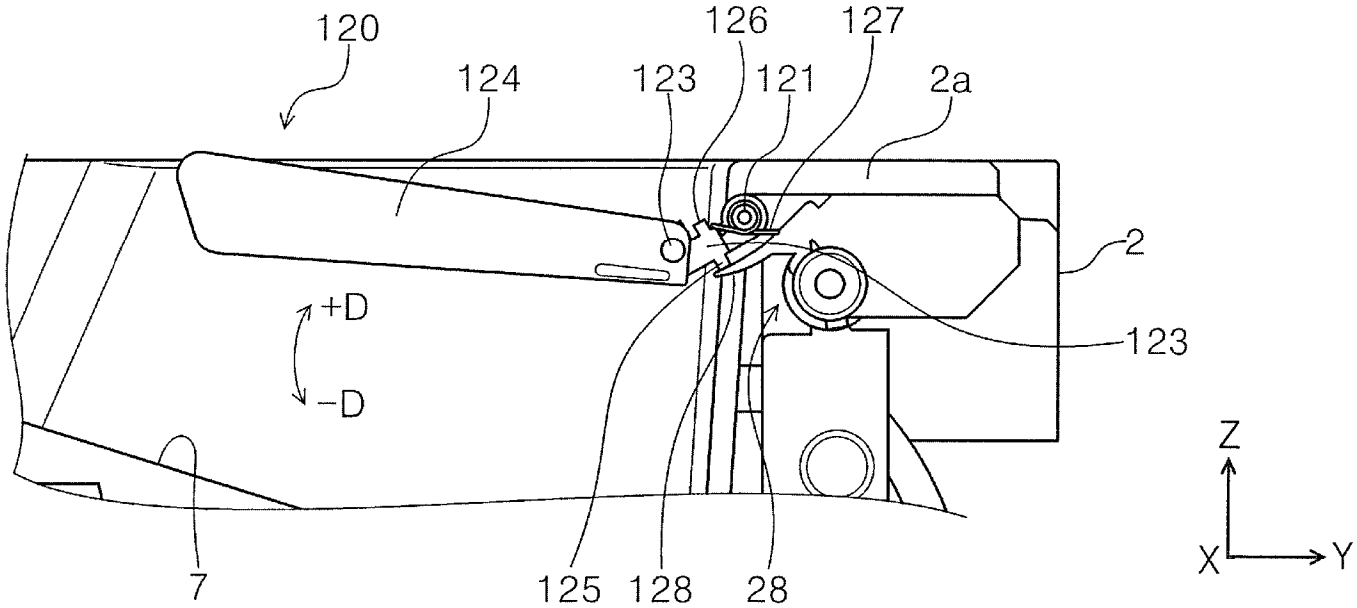
FIG. 37 is a lateral sectional diagram explaining a modification example of the retaining portion according to the third embodiment.
Figure 38:
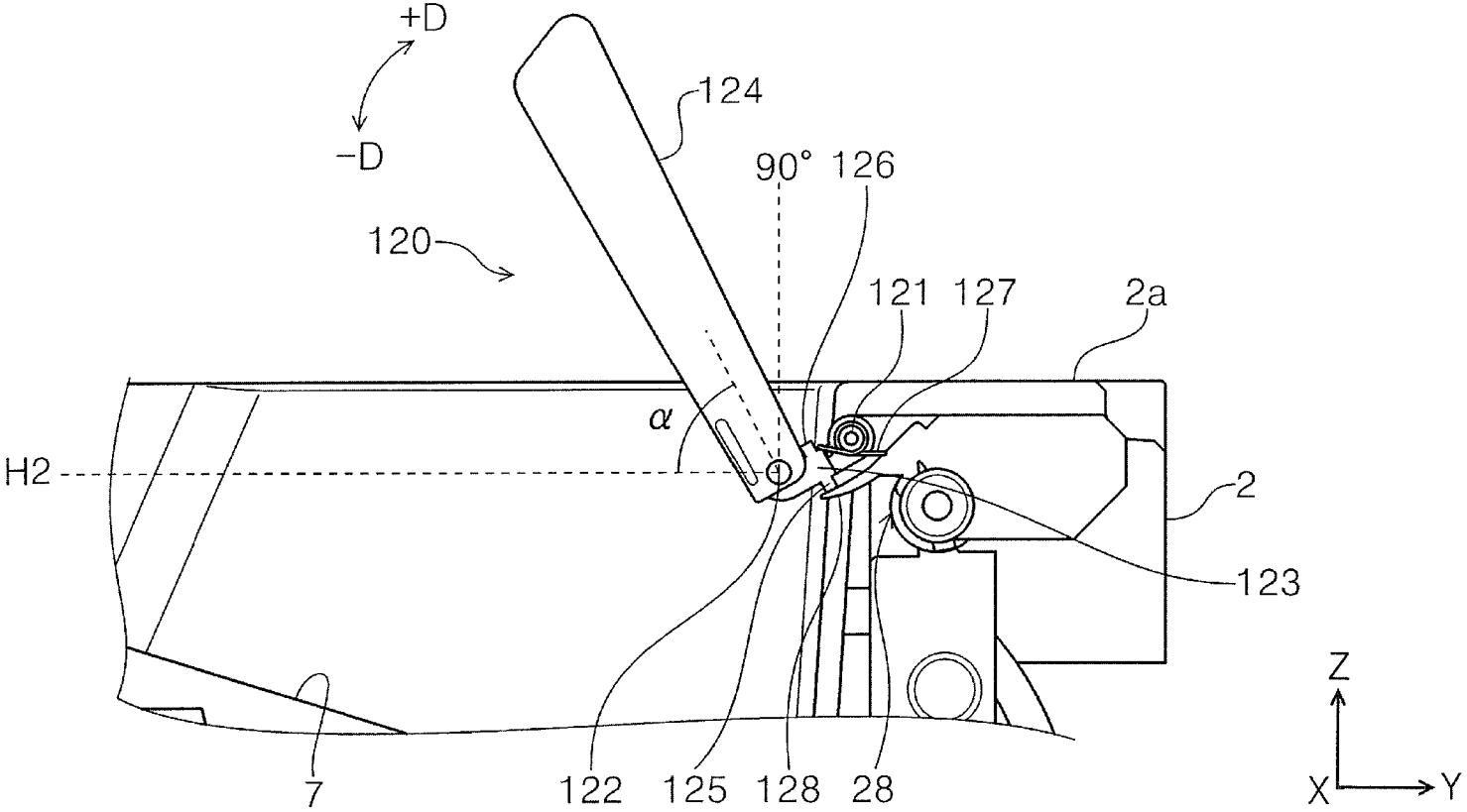
FIG. 38 is a lateral sectional diagram explaining a modification example of the retaining portion according to the third embodiment.

When a force is applied to the distal end member 124 and the distal end member 124 is lifted up, as illustrated in FIG. 37, the distal end member 124 rotationally moves in a direction (a +D direction illustrated by an arrow in FIG. 37) separating from the first paper discharge tray 7. As illustrated in FIG. 38, the base member 123 does not rotationally move until the distal end member 124 comes into contact with the second contact portion 126 which is provided on the base member 123.

Figure 39:
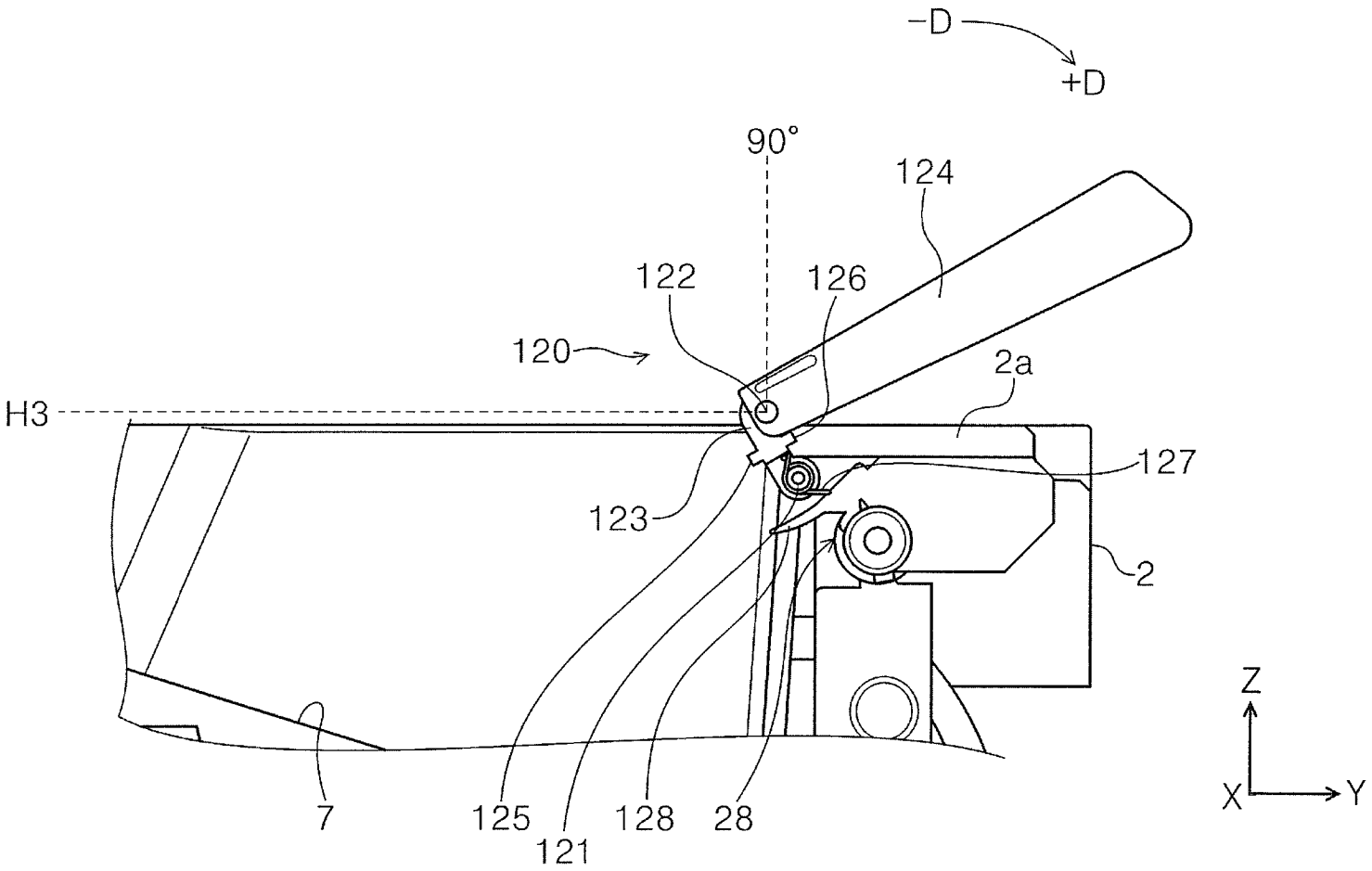
FIG. 39 is a lateral sectional diagram explaining a modification example of the retaining portion according to the third embodiment.

When a force in the +D direction is further applied to the distal end member 124 after the distal end member 124 comes into contact with the second contact portion 126, as illustrated in FIG. 39, the base member 123 rotationally moves in the +D direction against the pressing force of the pressing member 127 and the distal end member 124 rotationally moves from the horizontal plane (for example, the X-Y plane at the dotted line position illustrated by reference numeral H3 in FIG. 39) by an angle greater than or equal to 90°.

In the present embodiment, in the state of FIG. 38 in which the distal end member 124 comes into contact with the second contact portion 126 which is provided on the base member 123, the distal end member 124 is configured to assume a position between the horizontal plane (for example, the X-Y plane at the dotted line position illustrated by reference numeral H2 in FIG. 38) and 90° from the horizontal plane, that is, to assume a position forming an acute angle with the horizontal plane.

Accordingly, it is possible to adopt a configuration in which, in a case in which a force in the +D direction is no longer applied to the distal end member 124 after the retaining portion 120 is set to the state of FIG. 39 the base member 123 is pressed by the pressing member 127 and rotationally moves in the −D direction to return to the state of FIG. 38, and the distal end member 124 rotationally moves in the −D direction under the weight of the distal end member 124 itself to return to the state of FIG. 36.

According to the configuration described above, it is possible to realize a configuration in which, in a case in which the retaining portion 120 rotationally moves in the +D direction, the retaining portion 120 is capable of rotationally moving from the horizontal plane by an angle greater than or equal to 90° without providing the housing 2 with the discharge portion cover 114 which is described in the third embodiment.

In the present embodiment, although the second rotational movement shaft 122 is exposed to the outside of the housing 2, since the first rotational movement shaft 121 is on the inside of the housing 2 and the apparatus inner portion is not easily seen, it is possible to maintain the aesthetic of the entirety of the apparatus.

Since a configuration is adopted in which, in a case in which the base member 123 is pressed by the pressing member 127 in the progress direction (the −D direction) which retains the paper toward the first paper discharge tray 7 and the retaining portion 120 rotationally moves from the retaining posture of the paper in a direction separating from the first paper discharge tray 7, when the distal end member 124 rotationally moves by a predetermined angle α (refer to FIG. 38) with respect to the base member 123, the base member 123 rotationally moves in a direction separating from the first paper discharge tray 7 (the +D direction) against the pressing force of the pressing member 127, it is possible to adopt a configuration in which the retaining portion 120 easily returns to the retaining posture of the paper (FIG. 36). Although the angle α may be an acute angle (α<90°) such that the distal end member 124 returns under the weight of the distal end member 124 itself, even in a case in which the angle α exceeds 90°, it is possible to facilitate the distal end member 124 also easily and automatically rotationally moving in the −D direction with the force of the base member 123 returning in the −D direction.

The invention is not limited to the embodiments described above and may be modified in various ways within the scope of the invention described in the claims, and the modifications should be construed as being included in the invention.

The entire disclosure of Japanese Patent Application No. 2017-219135, filed Nov. 14, 2017, and No. 2018-030971, filed Feb. 23, 2018 are expressly incorporated by reference herein.

What is claimed is:

1. A recording apparatus comprising:

a recording unit which performs recording on a medium;

a discharge portion which discharges the medium after the recording by the recording unit;

a placement portion on which the medium which is discharge from the discharge portion is placed; and a retainer which includes a plurality of retaining portions which retains the medium toward the placement portion on a downstream in a medium discharge direction of the discharge portion, wherein the plurality of retaining portions includes a first retaining portion and a second retaining portion which retains closer to an upstream in the medium discharge direction than a retaining position of the first retaining portion, wherein the retaining portions are configured to be capable of rotationally moving by an angle greater than or equal to 90° from a horizontal plane in a case in which the retaining portions rotationally move in a direction separating from the placement portion from a retaining posture which retains the medium toward the placement portion.

2. The recording apparatus according to claim 1, wherein the second retaining portion is disposed deviated in a width direction which intersects the medium discharge direction with respect to the first retaining portion, wherein the first retaining portion is provided in a center region in the width direction, and wherein the second retaining portion is provided as a pair on both sides of the first retaining portion in the width direction.

3. The recording apparatus according to claim 1, wherein the plurality of retaining portions further includes a third retaining portion or a third retaining portion to an nth retaining portion (n≥4) in addition to the first retaining portion and the second retaining portion, and wherein a kth retaining portion (n≥k≥3) is provided as a pair on both sides of a k-1th retaining position (n≥k≥3) in the width direction which intersects the medium discharge direction and the kth retaining portion is configured to retain closer to the upstream in the medium discharge direction than the retaining position of the k-1th retaining portion (n≥k≥3).

4. The recording apparatus according to claim 3, wherein the retaining portions include rotational movement shafts on the discharge portion side, rock using the rotational movement shafts as axes, and are configured such that free ends which proceed and withdraw with respect to the medium retain the medium.

5. The recording apparatus according to claim 4, wherein in the plurality of retaining portions, the closer the retaining portion is positioned to an outside in the width direction, the greater a retaining force which retains the medium toward the placement portion.

6. The recording apparatus according to claim 5, wherein a predetermined retaining portion among the plurality of retaining portions overlaps a top side of the retaining portion which is first positioned on the outside in the width direction with respect to the predetermined retaining portion.

7. The recording apparatus according to claim 4, further comprising:

a cover portion which is capable of opening and closing and covers a space above the rotational movement shafts in a closed state, wherein the cover portion is configured to be pushed up by the retaining portions which rotationally move in a direction separating from the placement portion and to be capable of rotationally moving from the closed state to an open state.

8. The recording apparatus according to claim 4, further comprising:

a housing in which the discharge portion is provided, wherein the rotational movement shafts include a first rotational movement shaft and a second rotational movement shaft, wherein each of the retaining portions includes a base member which rocks in a direction of proceeding and withdrawing with respect to the placement portion using the first rotational movement shaft which is provided on the housing side as an axis, and a distal end member which rocks in a direction of proceeding and withdrawing with respect to the placement portion using the second rotational movement shaft which is provided on a free end side of the base member as an axis, the distal end member retaining the medium toward the placement portion, wherein the first rotational movement shaft is positioned such that a space above the first rotational movement shaft is covered by a portion of the housing, and wherein the second rotational movement shaft is positioned such that a space above the second rotational movement shaft is not covered by the housing.

9. The recording apparatus according to claim 8, wherein the base members are pressed in a progress direction in which the medium is retained toward the placement portion by a pressing member, and wherein in a case in which the retaining portions rotationally move from the retaining posture in a direction of separating from the placement portion, when the distal end members rotationally move by a predetermined angle with respect to the base members, the base members rotationally move in a direction of separating from the placement portion against a pressing force of the pressing member.

10. The recording apparatus according to claim 3, wherein among the plurality of retaining portions, the second retaining portion and the third retaining portion, or the second to the nth retaining portions (n≥4) are provided at positions corresponding to both ends in the width direction of the media of respectively different sizes.

11. The recording apparatus according to claim 1, further comprising:

a curved path which is provided on an upstream of the discharge portion in the medium discharge direction and which curves and inverts the medium after the recording by the recording unit.

12. The recording apparatus according to claim 1, wherein the retaining portions have a discharging function.

13. A recording apparatus comprising:

a recording unit which performs recording on a medium;

a discharge portion which discharges the medium after the recording by the recording unit;

a placement portion on which the medium which is discharge from the discharge portion is placed; and a retainer which includes a plurality of retaining portions which retains the medium toward the placement portion on a downstream in a medium discharge direction of the discharge portion, wherein the plurality of retaining portions includes a first retaining portion and a second retaining portion which retains closer to an upstream in the medium discharge direction than a retaining position of the first retaining portion, wherein the plurality of retaining portions further includes a third retaining portion or a third retaining portion to an nth retaining portion (n≥4) in addition to the first retaining portion and the second retaining portion, and wherein a kth retaining portion (n≥k≥3) is provided as a pair on both sides of a k-1th retaining position (n≥k≥3) in the width direction which intersects the medium discharge direction and the kth retaining portion is configured to retain closer to the upstream in the medium discharge direction than the retaining position of the k-1th retaining portion (n≥k≥3).

14. The recording apparatus according to claim 13, wherein the second retaining portion is disposed deviated in a width direction which intersects the medium discharge direction with respect to the first retaining portion, wherein the first retaining portion is provided in a center region in the width direction, and wherein the second retaining portion is provided as a pair on both sides of the first retaining portion in the width direction.

15. The recording apparatus according to claim 14, wherein the retaining portions include rotational movement shafts on the discharge portion side, rock using the rotational movement shafts as axes, and are configured such that free ends which proceed and withdraw with respect to the medium retain the medium.

16. The recording apparatus according to claim 15, wherein in the plurality of retaining portions, the closer the retaining portion is positioned to an outside in the width direction, the greater a retaining force which retains the medium toward the placement portion.

17. The recording apparatus according to claim 16, wherein a predetermined retaining portion among the plurality of retaining portions overlaps a top side of the retaining portion which is first positioned on the outside in the width direction with respect to the predetermined retaining portion.

18. The recording apparatus according to claim 13, wherein among the plurality of retaining portions, the second retaining portion and the third retaining portion, or the second to the nth retaining portions (n≥4) are provided at positions corresponding to both ends in the width direction of the media of respectively different sizes.

19. The recording apparatus according to claim 13, further comprising:

a curved path which is provided on an upstream of the discharge portion in the medium discharge direction and which curves and inverts the medium after the recording by the recording unit.

* * * * *